US007052341B2

(12) United States Patent
Kaji et al.

(10) Patent No.: US 7,052,341 B2
(45) Date of Patent: May 30, 2006

(54) METHOD AND APPARATUS FOR CONTROLLING A PROPULSIVE FORCE OF A MARINE VESSEL

(75) Inventors: Hirotaka Kaji, Shizuoka (JP); Isao Kanno, Shizuoka (JP)

(73) Assignees: Yamaha Hatsudoki Kabushiki Kaisha, Shizuoka-ken (JP); Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/969,725

(22) Filed: Oct. 20, 2004

(65) Prior Publication Data

US 2005/0164569 A1 Jul. 28, 2005

(30) Foreign Application Priority Data

Oct. 22, 2003 (JP) ..... 2003-361461

(51) Int. Cl.
*B63H 23/04* (2006.01)

(52) U.S. Cl. ..... 440/75; 441/1; 441/86

(58) Field of Classification Search ..... 440/1, 440/75, 86
See application file for complete search history.

(56) References Cited

U.S. PATENT DOCUMENTS 2,571,451 A * 10/1951 Humiston ..... 477/112
4,836,809 A * 6/1989 Pelligrino ..... 440/2
5,336,120 A * 8/1994 Maurer et al. ..... 440/84
5,711,742 A * 1/1998 Leinonen et al. ..... 477/121
6,200,177 B1 * 3/2001 Scott et al. ..... 440/75
6,293,838 B1 * 9/2001 Ferguson ..... 440/84
2004/0106337 A1 6/2004 Okabe
2004/0121661 A1 * 6/2004 Okuyama ..... 440/1

FOREIGN PATENT DOCUMENTS

| | | |
|---|---|---|
| JP | 62-167938 | 7/1987 |
| JP | 01-285486 | 11/1989 |
| JP | 02-227395 | 9/1990 |
| JP | 2000-313398 | 11/2000 |
| JP | 2001-152897 | 6/2001 |
| JP | 2001-265406 | 9/2001 |
| JP | 2004-175309 | 6/2004 |

* cited by examiner

*Primary Examiner*—Sherman Basinger
(74) *Attorney, Agent, or Firm*—Keating & Bennett, LLP

(57) ABSTRACT

A propulsive force controlling apparatus controls a propulsion system attached to a hull of a marine vessel. The propulsion system includes a motor, a propulsive force generating member which receives a torque from the motor to generate a propulsive force, a clutch mechanism which operates only in either a coupling state which permits transmission of the torque from the motor to the propulsive force generating member with virtually no slippage and a decoupling state which prohibits the transmission of the torque from the motor to the propulsive force generating member, and a clutch actuator which actuates the clutch mechanism.

13 Claims, 13 Drawing Sheets

METHOD AND APPARATUS FOR CONTROLLING A PROPULSIVE FORCE OF A MARINE VESSEL

BACKGROUND OF THE INVENTION

1. Field of the Invention

The present invention relates to a propulsive force controlling apparatus which is applicable to a marine vessel having a propulsion system, a marine vessel maneuvering supporting system and a marine vessel each including the propulsive force controlling apparatus, and a propulsive force controlling method.

2. Description of the Related Art

A propulsion system including an air-assist type engine and a multi-stage gear is conventionally used for causing a small-scale marine vessel (e.g., a boat) to run at a very low speed. The very low speed operation is required when a trolling operation is performed or the marine vessel is moved toward or away from a wharf.

However, the aforementioned propulsion system is not popular because of its complicated structure and high costs.

On the other hand, a hydraulic clutch controlling technique for a marine vessel engine is disclosed in Japanese Examined Patent Publication No. 06-68292 (1994). With the hydraulic clutch controlling technique, a multi-disk clutch is controlled to be switched alternately between a half-coupling state and a direct-coupling state to provide a desired trolling speed.

However, slippage occurs between clutch disks in the half-coupling state, thereby making it difficult to accurately control a propulsive force by detecting the rotational speed of a drive shaft provided at a stage before the clutch. With the hydraulic clutch controlling technique disclosed in Japanese Examined Patent Publication No. 06-68292, detection and feedback of the rotational speed of a propeller shaft provided at a stage subsequent to the clutch is required for accurate control of the propulsive force.

An outboard motor (another type of propulsion system) conventionally includes a dog clutch. The dog clutch does not have the half-coupling state, but has a coupling state and a decoupling state. Therefore, it is necessary to reduce an engine speed for reducing the trolling speed. However, it is impossible to reduce the engine speed to lower than an idling speed, making it impossible to perform the trolling operation at a very low speed.

SUMMARY OF THE INVENTION

To overcome the problems described above, preferred embodiments of the present invention provide a propulsive force controlling apparatus suitable for very low speed marine vessel running control, and a marine vessel maneuvering supporting system and a marine vessel each including the propulsive force controlling apparatus.

Other preferred embodiments of the present invention provide a propulsive force controlling method suitable for the very low speed marine vessel running control.

A propulsive force controlling apparatus according to one preferred embodiment of the present invention controls a propulsion system that is attached to a hull of a marine vessel and includes a motor, a propulsive force generating member which receives a torque from the motor to generate a propulsive force, a clutch mechanism which is switched between a coupling state which permits transmission of the torque from the motor to the propulsive force generating member with virtually no slippage and a decoupling state (neutral state) which prohibits the transmission of the torque from the motor to the propulsive force generating member, and a clutch actuator which actuates the clutch mechanism. The propulsive force controlling apparatus includes a target propulsive force acquiring section which acquires a target propulsive force to be generated by the propulsion system, and a clutch controlling section which controls the clutch actuator on the basis of the target propulsive force acquired by the target propulsive force acquiring section.

With this arrangement, the clutch actuator is controlled according to the target propulsive force to switch the clutch mechanism between the coupling state and the decoupling state. The clutch mechanism transmits the rotation of the motor to the propulsive force generating member with virtually no slippage, so that the propulsive force can accurately be controlled by controlling the clutch mechanism. Further, the propulsive force can be generated as having a very small magnitude by switching the propulsive force generating member between a rotation state and a non-rotation state. This makes it possible to move the marine vessel at a very low speed. Thus, the marine vessel can easily perform the trolling operation, and can easily be moved toward and away from a wharf.

The clutch mechanism may be, for example, a dog clutch.

The motor may be an engine (internal combustion engine), an electric motor or other type of motor.

The marine vessel may be a relatively small-scale marine vessel such as a cruiser, a fishing boat, a water jet or a watercraft.

The propulsion system may be an outboard motor, an inboard/outboard motor (stern drive), an inboard motor or a water jet drive. The outboard motor preferably includes a propulsion unit located outboard and having a motor and a propulsive force generating member (propeller), and a steering mechanism which horizontally turns the entire propulsion unit with respect to the hull. The inboard/outboard motor includes a motor located inboard, and a drive unit located outboard and having a propulsive force generating member and a steering mechanism. The inboard motor includes a motor and a drive unit provided inboard, and a propeller shaft extending outward from the drive unit. In this case, a steering mechanism is separately provided. The water jet drive is such that water sucked from the bottom of the marine vessel is accelerated by a pump and ejected from an ejection nozzle provided at a stern of the marine vessel to provide a propulsive force. In this case, a steering mechanism is preferably constituted by the ejection nozzle and a mechanism for turning the ejection nozzle in a horizontal plane.

The target propulsive force acquiring section may include a target rotational speed acquiring section which acquires a target rotational speed of the motor. In this case, the clutch controlling section controls the clutch actuator on the basis of the target rotational speed acquired by the target rotational speed acquiring section.

The clutch controlling section preferably includes a rotational speed comparing section which compares the target rotational speed acquired by the target rotational speed acquiring section with a predetermined lower limit. If a comparison result provided by the rotational speed comparing section indicates that the target rotational speed is not lower than the lower limit, the clutch controlling section maintains the clutch mechanism in the coupling state. If the target rotational speed is lower than the lower limit, the clutch controlling section performs an intermittent coupling control operation to intermittently maintain the clutch mechanism in the coupling state.

With this arrangement, the intermittent coupling control operation is performed when the target rotational speed of the motor is lower than the lower limit. That is, if the target rotational speed is not lower than the lower limit, the propulsive force is controlled by controlling the rotational speed of the motor. On the other hand, if the target rotational speed is lower than the lower limit, the propulsive force is generated to have a very small magnitude according to the target rotational speed, for example, by intermittently maintaining the clutch mechanism in the coupling state while maintaining the rotational speed of the motor at a constant level.

More specifically, the clutch controlling section preferably includes a coupling duration calculating section which calculates a duration of the coupling state in a predetermined control period according to the target propulsive force acquired by the target propulsive force acquiring section, and an intermittent coupling controlling section which maintains the clutch mechanism in the coupling state for the duration calculated by the coupling duration calculating section and maintains the clutch mechanism in the decoupling state for the rest of the control period for switching the clutch mechanism alternately between the coupling state and the decoupling state.

The apparatus preferably further includes a motor controlling section which drives the motor at a predetermined reference rotational speed (which may be equal to, for example, the lower limit) if the comparison result provided by the target rotational speed comparing section indicates that the target rotational speed is lower than the lower limit. In this case, the coupling duration calculating section preferably calculates the duration of the coupling state of the clutch mechanism so as to provide a propulsive force equivalent to a propulsive force to be generated by driving the motor at the target rotational speed, if the comparison result provided by the target rotational speed comparing section indicates that the target rotational speed is lower than the lower limit.

More specifically, the coupling duration calculating section may calculate the duration of the coupling state of the clutch mechanism from the following expression:

$$s=(Na/Nb)\cdot S$$

wherein s is the duration of the coupling state, Na is the target rotational speed, Nb is the reference rotational speed, and S is the control period.

That is, the coupling state duration s is preferably calculated so that a value (Nb×(s/S)) calculated by multiplying the reference rotational speed Nb by a quotient obtained by dividing the coupling state duration s by the control period S is equalized with the target rotational speed Na. A value (S−s) calculated by subtracting the coupling state duration s from the control period S indicates a period during which the clutch mechanism is maintained in the decoupling state (neutral state).

The reference rotational speed may be equal to the lower limit. Thus, the very low speed running can be achieved by performing the intermittent coupling control operation of the clutch mechanism while fixing the rotational speed of the motor at the lower limit. With the rotational speed of the motor fixed at the lower limit, energy saving can also be achieved.

Where the marine vessel includes a plurality of propulsion systems attached to the hull, the clutch controlling section preferably controls a plurality of clutch actuators provided in the respective propulsion systems so that clutch mechanisms provided in the respective propulsion systems are switched between the coupling state and the decoupling state in synchronization with each other during the intermittent coupling control operation for intermittently maintaining the clutch mechanisms in the coupling state.

With this arrangement, the respective propulsion systems generate propulsive forces in synchronization with each other, so that an operator's unnatural feeling and the crew's uncomfortable feeling can be eliminated to improve boarding and riding comfort.

The apparatus preferably further includes a motor state judging section which judges whether the motor is active or inactive. In this case, the clutch controlling section preferably interrupts the intermittent coupling control operation of the clutch mechanism if the motor state judging section determines that the motor is inactive during the intermittent coupling control operation, and restarts the intermittent coupling control operation when the motor state judging section thereafter determines that the motor is active.

With this arrangement, if the motor becomes inactive during the intermittent coupling control operation, the intermittent coupling control operation is interrupted and, immediately after the motor is restored to be active, the intermittent coupling control operation is restarted.

Where the marine vessel includes a plurality of propulsion systems attached to the hull, the motor state judging section judges whether motors provided in the respective propulsion systems are each active or inactive. The clutch controlling section preferably interrupts the intermittent coupling control operation of all clutch mechanisms provided in the respective propulsion systems if the motor state judging section determines that at least one of the motors is inactive during the intermittent coupling control operation of the clutch mechanisms.

This prevents the hull from moving in an undesired direction or from being undesirably rotated even if any of the propulsion systems becomes inactive which would unbalance the propulsive forces.

The apparatus preferably further includes a restart controlling section which restarts the motor judged to be inactive by the motor state judging section. Thus, the inactive motor is speedily restored to be active.

The clutch mechanism preferably can be switched among a forward drive coupling state in which the torque is transmitted from the motor to the propulsive force generating member so as to move the hull forward, a rearward drive coupling state in which the torque is transmitted from the motor to the propulsive force generating member so as to move the hull rearward, and the decoupling state which prohibits the transmission of the torque from the motor to the propulsive force generating member.

In this case, the clutch mechanism is switched alternately between the forward drive coupling state and the decoupling state or between the rearward drive coupling state and the decoupling state depending upon a direction of the propulsive force to be generated during the intermittent coupling control operation.

A marine vessel maneuvering supporting system according to one preferred embodiment of the present invention includes a propulsive force controlling apparatus having the aforementioned features, and a target propulsive force inputting section for inputting the target propulsive force to be acquired by the target propulsive force acquiring section.

With this arrangement, the very low speed marine vessel running operation can easily be performed by inputting the target propulsive force.

A marine vessel according to one preferred embodiment of the present invention includes a hull, a propulsion system attached to the hull and including a motor, a propulsive force generating member which receives a torque from the motor to generate a propulsive force, a clutch mechanism which is switched between a coupling state which permits transmission of the torque from the motor to the propulsive force generating member and a decoupling state which prohibits the transmission of the torque from the motor to the propulsive force generating member, and a clutch actuator which actuates the clutch mechanism, and a marine vessel maneuvering supporting system having the aforementioned features. With this arrangement, even an unskilled operator can easily perform the very low speed marine vessel running operation.

A propulsive force controlling method according to a preferred embodiment of the present invention is a method for controlling a propulsion system that is attached to a hull of a marine vessel and includes a motor, a propulsive force generating member which receives a torque from the motor to generate a propulsive force, a clutch mechanism which is switched between a coupling state which permits transmission of the torque from the motor to the propulsive force generating member and a decoupling state which prohibits the transmission of the torque from the motor to the propulsive force generating member, and a clutch actuator which actuates the clutch mechanism. The method includes the steps of acquiring a target propulsive force to be generated by the propulsion system, and controlling the clutch actuator on the basis of the target propulsive force acquired in the target propulsive force acquiring step.

This method makes it possible to accurately control the propulsive force by controlling the clutch mechanism and to easily perform the very low speed marine vessel running operation.

The target propulsive force acquiring step preferably includes the step of acquiring a target rotational speed of the motor. In this case, the clutch controlling step preferably includes the step of controlling the clutch actuator on the basis of the acquired target rotational speed.

The clutch controlling step preferably includes the steps of comparing the acquired target rotational speed with a predetermined lower limit, maintaining the clutch mechanism in the coupling state if the target rotational speed is not lower than the lower limit, and performing an intermittent coupling control operation to intermittently maintain the clutch mechanism in the coupling state if the target rotational speed is lower than the lower limit. In this method, the propulsive force is generated as having a very small magnitude corresponding to a target rotational speed lower than the lower limit by the intermittent coupling control operation. Thus, the very low speed marine vessel running operation can be performed.

The foregoing and other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
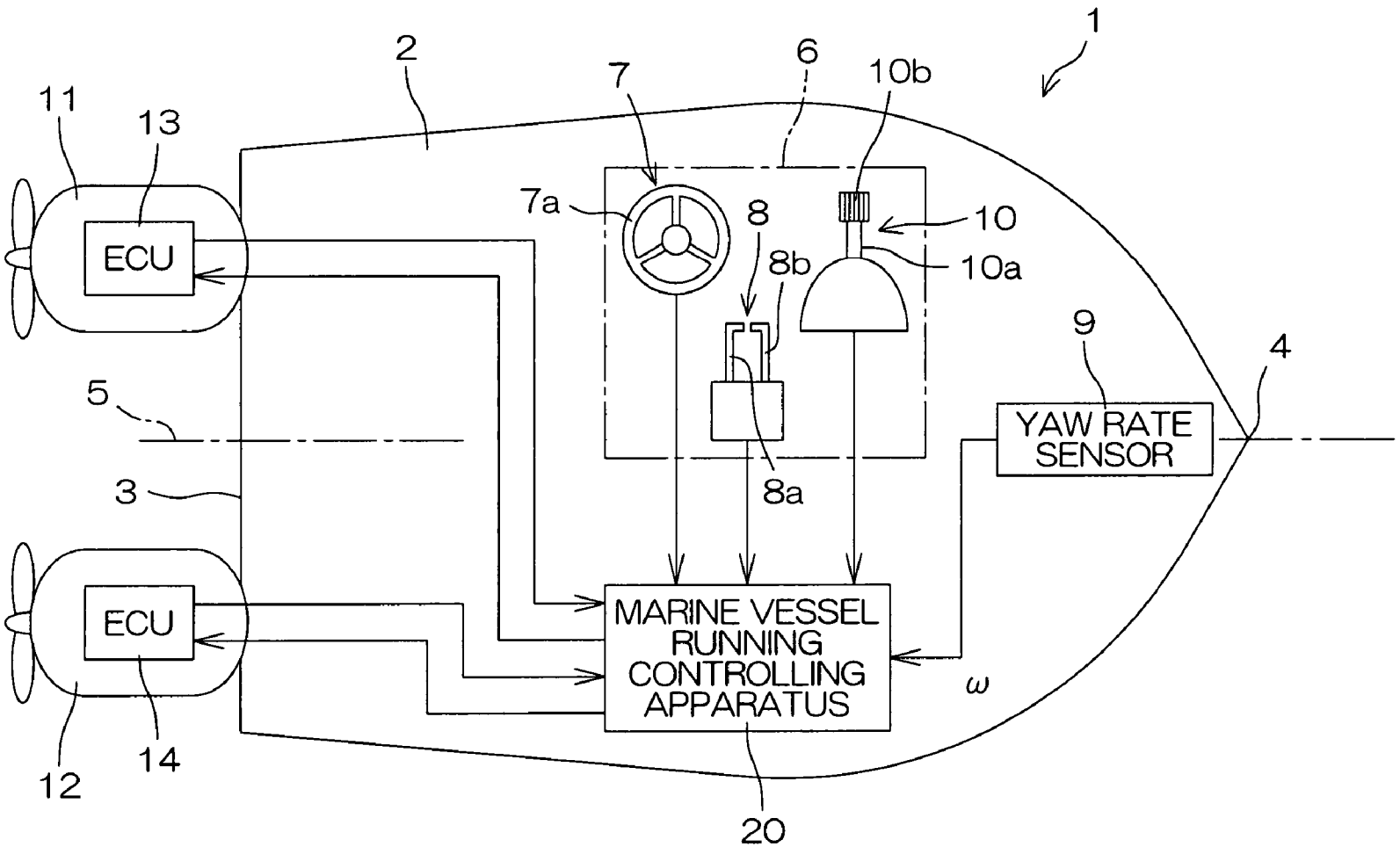
FIG. 1 is a schematic diagram illustrating a marine vessel according to one preferred embodiment of the present invention.

FIG. 1 is a schematic diagram illustrating a marine vessel 1 according to one preferred embodiment of the present invention. The marine vessel 1 is a relatively small-scale marine vessel, such as a cruiser or a boat, and includes a pair of outboard motors 11, 12 attached to a stern (transom) 3 of a hull 2. The outboard motors 11, 12 are positioned laterally symmetrically with respect to a center line 5 of the hull 2 extending through the stern 3 and a stem 4 of the hull 2. That is, the outboard motor 11 is attached to a rear port-side portion of the hull 2, while the outboard motor 12 is attached to a rear starboard-side portion of the hull 2. The outboard motor 11 and the outboard motor 12 will hereinafter be referred to as "port-side outboard motor 11" and "starboard-side outboard motor 12", respectively, to differentiate therebetween. Electronic control units 13 and 14 (hereinafter referred to as "outboard motor ECU 13" and "outboard motor ECU 14", respectively) are incorporated in the port-side outboard motor 11 and the starboard-side outboard motor 12, respectively.

The marine vessel 1 includes a control console 6 for controlling the marine vessel 1. The control console 6 includes, for example, a steering operational section 7 for performing a steering operation, a throttle operational section 8 for controlling the outputs of the outboard motors 11, 12, and a lateral movement operational section 10 (defining a target combined propulsive force acquiring section and a target movement angle acquiring section). The lateral movement operational section 10 is for laterally moving the marine vessel 1, while keeping a constant turning angular speed of the marine vessel 1 (stem turning speed is kept at zero, for example). The steering operational section 7 includes a steering wheel 7*a*. The throttle operational section 8 includes throttle levers 8*a*, 8*b* for the port-side outboard motor 11 and the starboard-side outboard motor 12. In this preferred embodiment, the lateral movement operational section 10 is defined by a joystick type input device which includes an upright operation lever 10*a* (defining a target propulsive force inputting section and a target movement angle inputting section) and a stem turning speed adjusting knob 10*b* (defining a target angular speed inputting section) rotatably provided on the top of the operation lever 10*a*.

The operational signals of the operational sections 7, 8, 10 provided on the control console 6 are input as electric signals to a marine vessel running controlling apparatus 20, for example, via a LAN (local area network, hereinafter referred to as "inboard LAN") provided in the hull 2. The marine vessel running controlling apparatus 20 includes an electronic control unit (ECU) including a microcomputer, and functions as a propulsive force controlling apparatus for propulsive force control and as a steering controlling apparatus for steering control. A yaw rate sensor 9 (angular speed detecting section) for detecting the angular speed (yaw rate or stem turning speed) of the hull 2 outputs an angular speed signal, which is also input to the marine vessel running controlling apparatus 20 via the inboard LAN.

The marine vessel running controlling apparatus 20 communicates with the outboard motor ECUs 13, 14 via the inboard LAN. More specifically, the marine vessel running controlling apparatus 20 acquires engine speeds (rotational speeds of motors) NL, NR of the outboard motors 11, 12 and steering angles $\phi L$, $\phi R$ of the outboard motors 11, 12 indicating the orientations of the outboard motors 11, 12 from the outboard motor ECUs 13, 14. The marine vessel running controlling apparatus 20 applies data including target steering angles $\phi L_t$, $\phi R_t$ (wherein a suffix "t" hereinafter means "target"), target throttle opening degrees, target shift positions (forward drive, neutral and reverse drive positions) and target trim angles to the outboard motor ECUs 13, 14.

In this preferred embodiment, the marine vessel running controlling apparatus 20 includes a control mode to be switched between an ordinary running mode in which the outboard motors 11, 12 are controlled according to the operations of the steering operational section 7 and the throttle operational section 8 and a lateral movement mode in which the outboard motors 11, 12 are controlled according to the operation of the lateral movement operational section 10. More specifically, the marine vessel running controlling apparatus 20 is operative in the ordinary running mode when an input from the steering operational section 7 or the throttle operational section 8 is detected, and is operative in the lateral movement mode when the operation of the lateral movement operational section 10 is detected.

In the ordinary running mode, the marine vessel running controlling apparatus 20 controls the outboard motors 11, 12 according to the operation of the steering wheel 7*a* such that the steering angles $\phi L$, $\phi R$ are substantially equal to each other. That is, the outboard motors 11, 12 generate propulsive forces that are parallel with each other. In the ordinary running mode, the marine vessel running controlling apparatus 20 determines the target throttle opening degrees and the target shift positions of the outboard motors 11, 12 according to the operation positions and directions of the throttle levers 8*a*, 8*b*. The throttle levers 8*a*, 8*b* are each inclinable forward and reverse. When an operator inclines the throttle lever 8*a* forward from a neutral position by a certain amount, the marine vessel running controlling apparatus 20 sets the target shift position of the port-side outboard motor 11 at the forward drive position. When the operator inclines the throttle lever 8*a* further forward, the marine vessel running controlling apparatus 20 sets the target throttle opening degree of the port-side outboard motor 11 according to the position of the throttle lever 8*a*. On the other hand, when the operator inclines the throttle lever 8*a* reverse by a certain amount, the marine vessel running controlling apparatus 20 sets the target shift position of the port-side outboard motor 11 at the reverse drive position. When the operator inclines the throttle lever 8*a* further reverse, the marine vessel running controlling apparatus 20 sets the target throttle opening degree of the port-side outboard motor 11 according to the position of the throttle lever 8*a*. Similarly, the marine vessel running controlling apparatus 20 sets the target shift position and the target throttle opening degree of the starboard-side outboard motor 12 according to the operation of the throttle lever 8*b*.

Upper portions of the throttle levers 8*a*, 8*b* are bent toward each other to constitute generally horizontal holders. With this arrangement, the operator can simultaneously operate the throttle levers 8*a*, 8*b* to control the outputs of the outboard motors 11, 12 with the throttle opening degrees of the port-side and starboard-side outboard motors 11, 12 maintained substantially the same.

In the lateral movement mode, the marine vessel running controlling apparatus 20 sets the target steering angles $\phi L_t$, $\phi R_t$, the target shift positions and the target throttle opening degrees of the port-side and starboard-side outboard motors 11, 12 according to the operation of the lateral movement operational section 10. A control operation to be performed in the lateral movement mode will be described in detail below.

Figure 2:
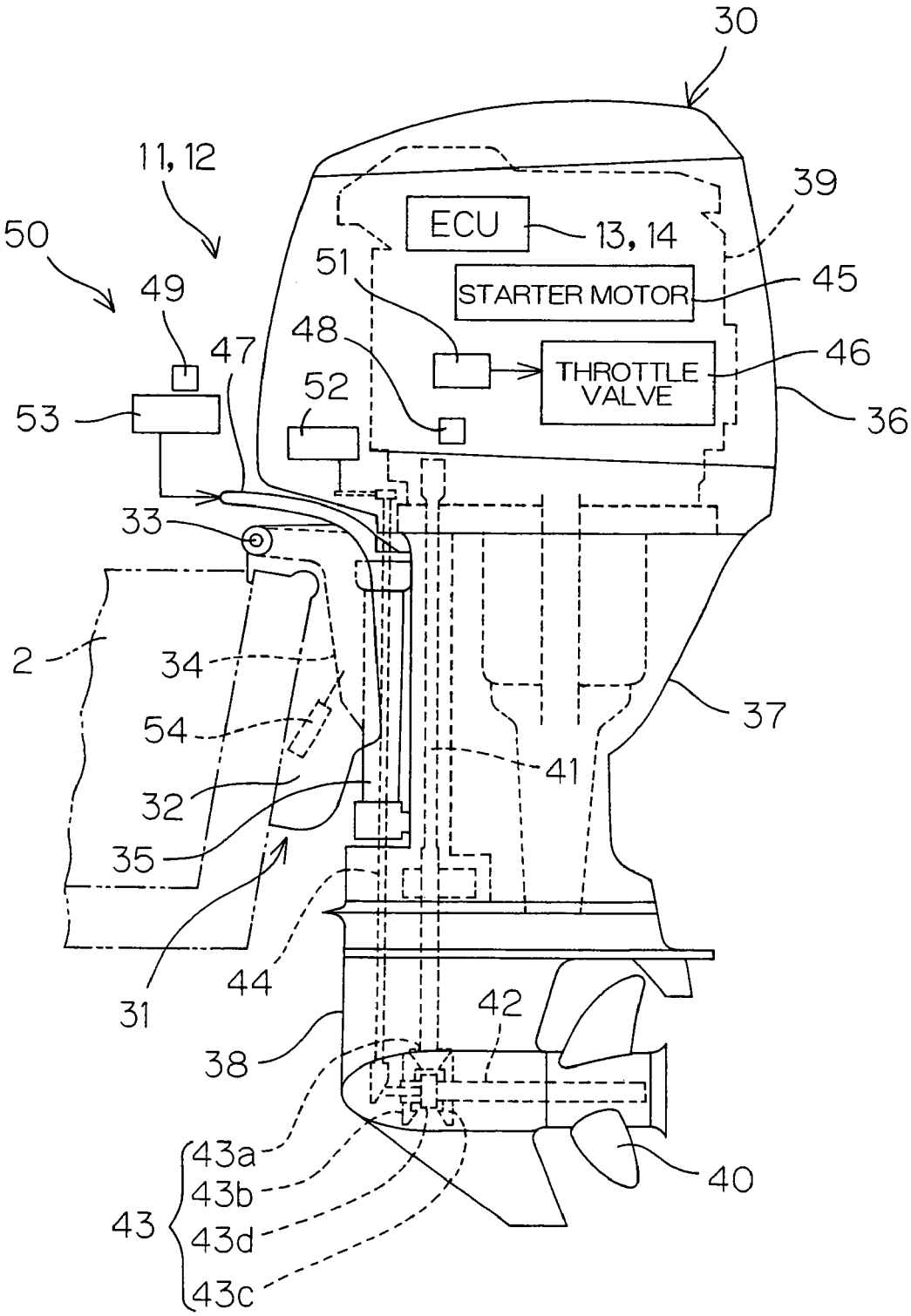
FIG. 2 is a schematic sectional view illustrating an outboard motor.

FIG. 2 is a schematic sectional view illustrating the common construction of the outboard motors 11, 12. The outboard motors 11, 12 each include a propulsion unit 30, and an attachment mechanism 31 for attaching the propulsion unit 30 to the hull 2. The attachment mechanism 31 includes a clamp bracket 32 detachably fixed to the transom of the hull 2, and a swivel bracket 34 connected to the clamp bracket 32 pivotally about a tilt shaft 33 (horizontal pivot axis). The propulsion unit 30 is attached to the swivel bracket 34 pivotally about a steering shaft 35. Thus, the steering angle (which is equivalent to an angle defined by the direction of the propulsive force with respect to the center line of the hull 2) is changed by pivoting the propulsion unit 30 about the steering shaft 35. Further, the trim angle of the propulsion unit 30 (which is equivalent to an angle defined by the direction of the propulsive force with respect to a horizontal plane) can be changed by pivoting the swivel bracket 34 about the tilt shaft 33.

The propulsion unit 30 has a housing which includes a top cowling 36, an upper case 37 and a lower case 38. An engine 39 is provided in the top cowling 36 with an axis of a crank shaft thereof extending vertically. A drive shaft 41 for transmitting power is coupled to a lower end of the crank shaft of the engine 39, and vertically extends through the upper case 37 into the lower case 38.

A propeller 40 defining a propulsive force generating member is rotatably attached to a lower rear portion of the lower case 38. A propeller shaft 42 (rotation shaft) of the propeller 40 extends horizontally in the lower case 38. The rotation of the drive shaft 41 is transmitted to the propeller shaft 42 via a shift mechanism 43.

The shift mechanism 43 includes a beveled drive gear 43*a* fixed to a lower end of the drive shaft 41, a beveled forward drive gear 43*b* rotatably provided on the propeller shaft 42, a beveled reverse drive gear 43*c* rotatably provided on the propeller shaft 42, and a dog clutch 43*d* provided between the forward drive gear 43*b* and the reverse drive gear 43*c*.

The forward drive gear 43*b* is meshed with the drive gear 43*a* from a forward side, and the reverse drive gear 43*c* is meshed with the drive gear 43*a* from a reverse side. Therefore, the forward drive gear 43*b* and the reverse drive gear 43*c* rotate in opposite directions when engaged with the drive gear 43*a*.

On the other hand, the dog clutch 43*d* is in spline engagement with the propeller shaft 42. That is, the dog clutch 43*d* is axially slidable with respect to the propeller shaft 42, but is rotatable relative to the propeller shaft 42. Therefore, the dog clutch 43*d* is rotatable together with the propeller shaft 42.

The dog clutch 43*d* is slidable on the propeller shaft 42 by pivotal movement thereof about a shift rod 44 that extends vertically parallel to the drive shaft 41. Thus, the dog clutch 43*d* is shifted between a forward drive position at which it is engaged with the forward drive gear 43*b*, at a reverse drive position at which it is engaged with the reverse drive gear 43*c*, or at a neutral position at which it is not engaged with either the forward drive gear 43*b* or the reverse drive gear 43*c*.

When the dog clutch 43*d* is in the forward drive position, the rotation of the forward drive gear 43*b* is transmitted to the propeller shaft 42 via the dog clutch 43*d* with virtually no slippage between the dog clutch 43*d* and the propeller shaft 42. Thus, the propeller 40 is rotated in one direction (in a forward drive direction) to generate a propulsive force in a direction for moving the hull 2 forward. On the other hand, when the dog clutch 43*d* is in the reverse drive position, the rotation of the reverse drive gear 43*c* is transmitted to the propeller shaft 42 via the dog clutch 43*d* with virtually no slippage between the dog clutch 43*d* and the propeller shaft 42. The reverse drive gear 43*c* is rotated in a direction opposite to that of the forward drive gear 43*b*, as mentioned above. The propeller 40 is therefore rotated in an opposite direction (in a reverse drive direction). Thus, the propeller 40 generates a propulsive force in a direction for moving the hull 2 reverse. When the dog clutch 43*d* is at the neutral position, the rotation of the drive shaft 41 is not transmitted to the propeller shaft 42. That is, transmission of a driving force between the engine 39 and the propeller 40 is prevented, such that no propulsive force is generated in either of the forward and reverse directions.

A starter motor 45 for starting the engine 39 is connected to the engine 39. The starter motor 45 is controlled by the outboard motor ECU 13, 14. The propulsive unit 30 further includes a throttle actuator 51 for actuating a throttle valve 46 of the engine 39 in order to change the throttle opening degree to change the intake air amount of the engine 39. The throttle actuator 51 may be an electric motor. The operation of the throttle actuator 51 is controlled by the outboard motor ECU 13, 14. The engine 39 includes an engine speed detecting section 48 for detecting the rotation of the crank shaft to detect the engine speed NL, NR of the engine 39.

A shift actuator 52 (clutch actuator) for changing the shift position of the dog clutch 43*d* is provided in cooperation with the shift rod 44. The shift actuator 52 is, for example, an electric motor, and its operation is controlled by the outboard motor ECU 13, 14.

Further, a steering actuator 53 which includes, for example, a hydraulic cylinder and is controlled by the outboard motor ECU 13, 14 is connected to a steering rod 47 fixed to the propulsion unit 30. By driving the steering actuator 53, the propulsion unit 30 is pivoted about the steering shaft 35 for a steering operation. The steering actuator 53, the steering rod 47 and the steering shaft 35 define a steering mechanism 50. The steering mechanism 50 includes a steering angle sensor 49 for detecting the steering angle $\phi L$, $\phi R$.

A trim actuator (tilt trim actuator) 54 which includes, for example, a hydraulic cylinder and is controlled by the outboard motor ECU 13, 14 is provided between the clamp bracket 32 and the swivel bracket 34. The trim actuator 54 pivots the propulsion unit 30 about the tilt shaft 33 by pivoting the swivel bracket 34 about the tilt shaft 33. Thus, the trim angle of the propulsion unit 30 can be adjusted.

Figure 3:
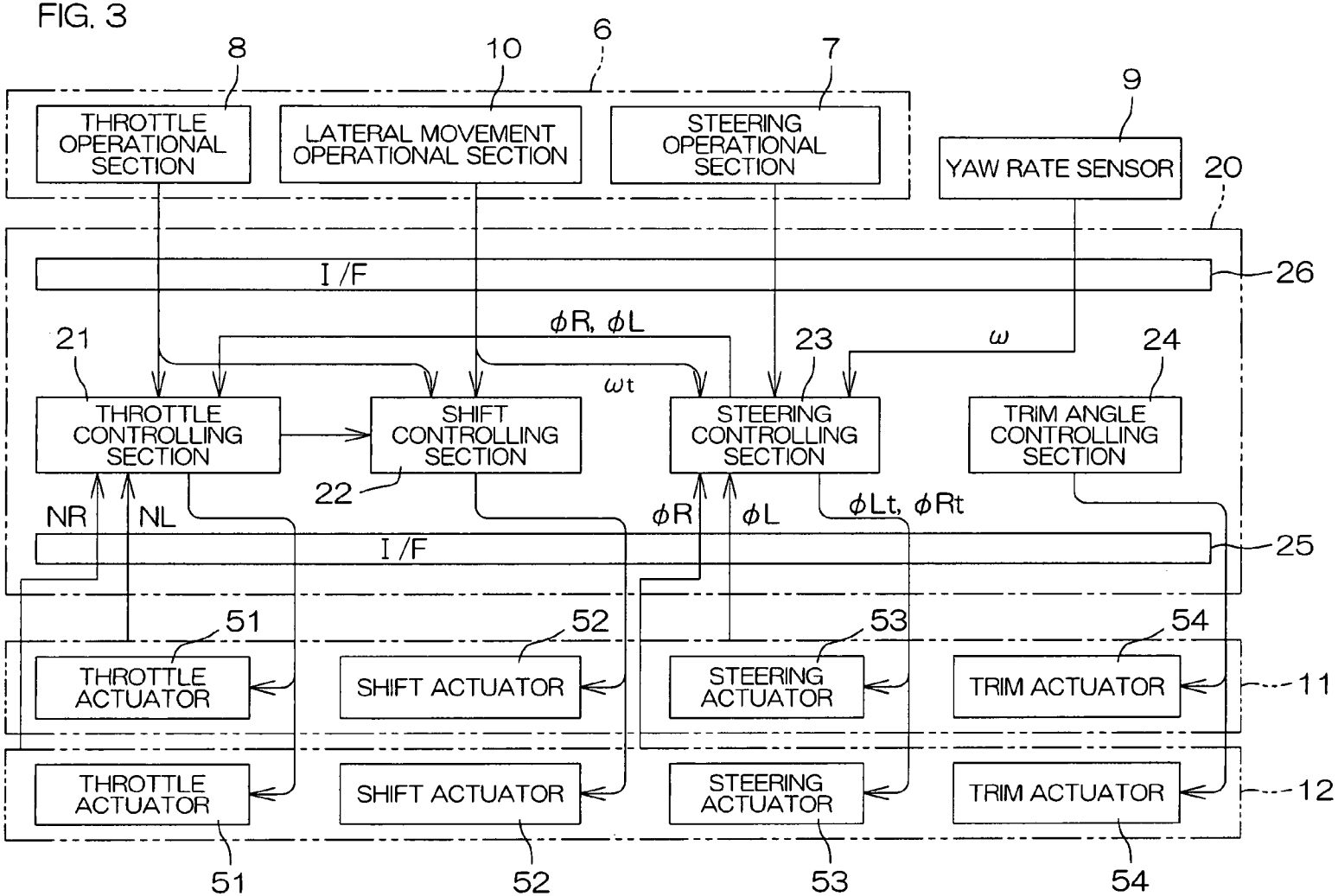
FIG. 3 is a block diagram illustrating a marine vessel running controlling system for controlling running of the marine vessel.

FIG. 3 is a block diagram illustrating a marine vessel maneuvering supporting system for controlling the running of the marine vessel 1. The marine vessel running controlling apparatus 20 includes a throttle controlling section 21 which issues command signals regarding the target throttle opening degrees for controlling the throttle actuators 51 of the port-side and starboard-side outboard motors 11, 12, a shift controlling section 22 (clutch controlling section) which issues command signals of the target shift positions for controlling the shift actuators 52 of the outboard motors 11, 12, a steering controlling section 23 which issues command signals of the target steering angles $\phi L_t$, $\phi R_t$ for controlling the steering actuators 53 of the outboard motors 11, 12, and a trim angle controlling section 24 which issues command signals of the target trim angles for controlling the trim actuators 54 of the outboard motors 11, 12. The functions of each of these controlling sections 21 to 24 may be provided by a predetermined software-based process performed by the microcomputer provided in the marine vessel running controlling apparatus 20.

The command signals generated by the respective controlling sections 21 to 24 are applied to the outboard motor ECUs 13, 14 via an interface (I/F) 25. The outboard motor ECUs 13, 14 control the actuators 51 to 54 based on the applied command signals.

The outboard motor ECUs 13, 14 respectively apply the engine speeds NL, NR detected by the engine speed detecting sections 48 and the steering angles $\phi L$, $\phi R$ detected by the steering angle sensors 49 to the marine vessel running controlling apparatus 20 via the interface 25. More specifically, the engine speeds NL, NR are applied to the throttle controlling section 21, and the steering angles $\phi L$, $\phi R$ are applied to the steering controlling section 23. The steering angles $\phi L$, $\phi R$ may also be applied to the throttle controlling section 21 from the steering controlling section 23. The target steering angles $\phi L_t$, $\phi R_t$ may be applied instead of the steering angles $\phi L$, $\phi R$ to the throttle controlling section 21 from the steering controlling section 23.

On the other hand, signals from the steering operational section 7, the throttle operational section 8, the yaw rate sensor 9 and the lateral movement operational section 10 are input to the marine vessel running controlling apparatus 20 via an interface (I/F) 26. More specifically, signals indicating the target steering angles $\phi L_t$, $\phi R_t$ are input from the steering operational section 7 to the steering controlling section 23. Signals indicating the magnitudes of the target propulsive forces are input from the throttle operational section 8 to the throttle controlling section 21, and signals indicating the directions of the propulsive forces are input from the throttle operational section 8 to the shift controlling section 22. The angular speed ω detected by the yaw rate sensor 9 is input to the steering controlling section 23.

Signals indicating a target combined propulsive force and a target movement angle (direction) are input from the lateral movement operational section 10 to the throttle controlling section 21, and a target angular speed $\omega_t$ set by the operation of the stem turning speed adjusting knob 10*b* is input from the lateral movement operational section 10 to the steering controlling section 23.

An intermittent shift command signal is also applied to the shift controlling section 22 from the throttle controlling section 21. Based on the intermittent shift command signal, the controlling section 22 performs an intermittent shift operation. In the intermittent shift operation, the shift controlling section 22 shifts the dog clutches 43*d* alternately between the neutral position and the forward drive position or between the neutral position and the reverse drive position. The intermittent shift operation is performed when the engine speeds for the target propulsive forces are lower than an idle speed of the engines 39 (a lower limit engine speed, for example, 700 rpm). The intermittent shift operation makes it possible to generate propulsive forces for engine speeds lower than the idle speed. The intermittent shift operation will be described in detail below.

Figure 4:
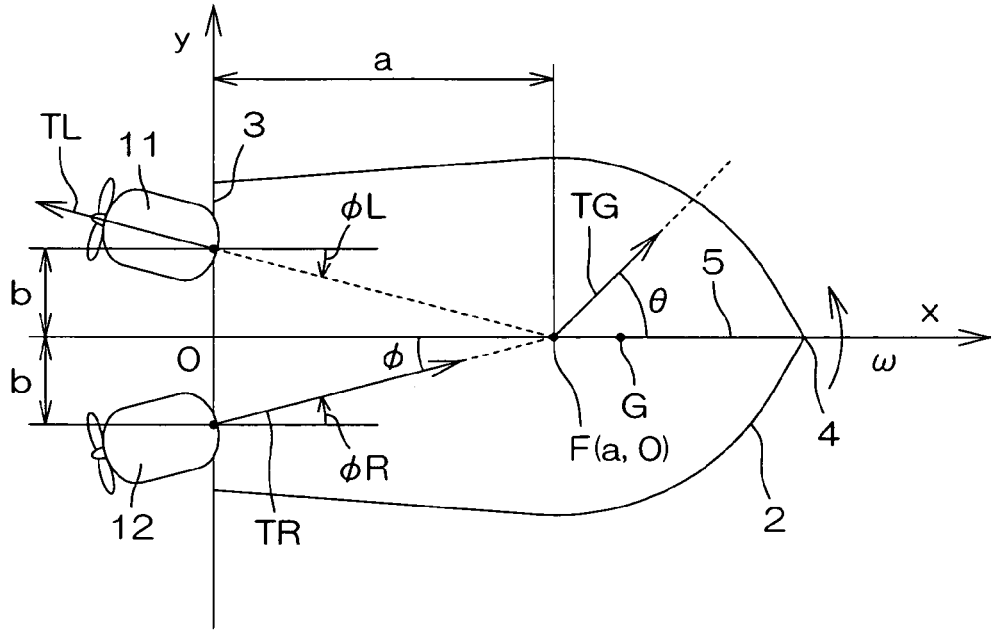
FIG. 4 is a diagram illustrating an operation for moving a hull in a lateral movement mode.

FIG. 4 is a diagram for explaining an operation for moving the marine vessel 1 in the lateral movement mode. A point at which the center line 5 of the hull 2 intersects the stern 3 is defined as an origin O. An axis extending along the center line 5 toward the stem 4 is defined as an x-axis, and an axis extending along the stern 3 (transom) toward the port side is defined as a y-axis. The origin O is a midpoint between propulsive force generating points at which the propulsive forces are generated by the respective propulsion units 30 provided in the outboard motors 11, 12.

In the lateral movement mode, the steering controlling section 23 sets the target steering angles $\phi L_t$, $\phi R_t$ of the port-side and starboard-side outboard motors 11, 12 such that action lines (indicated by broken lines) extending along vectors TL, TR of the propulsive forces generated by the respective outboard motors 11, 12 intersect each other in a predetermined location on the x-axis and the target angular speed $\omega_t$ is attained. At this time, the trim angle controlling section 24 controls the port-side and starboard-side outboard motors 11, 12 such that the trim angles of the respective outboard motors 11, 12 are substantially equal to each other so that horizontal components of the propulsive forces generated by the propulsion units 30 of the respective outboard motors 11, 12 are substantially equal to each other.

It is assumed that the intersection of the action lines of the propulsive force vectors TL, TR is defined as an action point F=(a,0) (wherein a>0), and the port-side and starboard-side outboard motors 11, 12 respectively generate the propulsive forces at positions (0,b), (0,−b) (wherein b is a constant value b>0) symmetrical with respect to the center line 5. If the steering angle ϕR of the starboard-side outboard motor 12 is ϕR=ϕ, the steering angle ϕL of the port-side outboard motor 11 is expressed by ϕL=−ϕ. Here, the angle ϕ is expressed by $\phi=\tan^{-1}(b/a)$.

A combined vector obtained by combining the propulsive force vectors TL, TR at the action point F is herein expressed by TG. The direction of the combined vector TG (which forms a movement angle θ with the x-axis) indicates the direction of the combined propulsive force (the movement direction of the hull 2), and the magnitude of the combined vector TG indicates the magnitude of the combined propulsive force. Therefore, it is necessary to direct the combined vector TG at the target movement angle $\theta_t$ (corresponding to the inclination direction of the operation lever 10*a*) applied from the lateral movement operational section 10 and to equalize the magnitude |TG| of the combined vector TG with the magnitude of the target combined propulsive force (corresponding to the inclination amount of the operation lever 10*a*) applied from the lateral movement operational section 10. In other words, target propulsive force vectors $TL_t$, $TR_t$ for the port-side and starboard-side outboard motors 11, 12 are determined so as to provide the aforementioned combined vector TG.

The simplest case is such that the action point F coincides with an instantaneous center G of the marine vessel 1. In this case, the angular speed ω of the hull 2 (angular speed about the instantaneous center G) is zero, so that the hull 2 laterally moves parallel with the orientation of the stem 4 being maintained unchanged.

Figure 5:
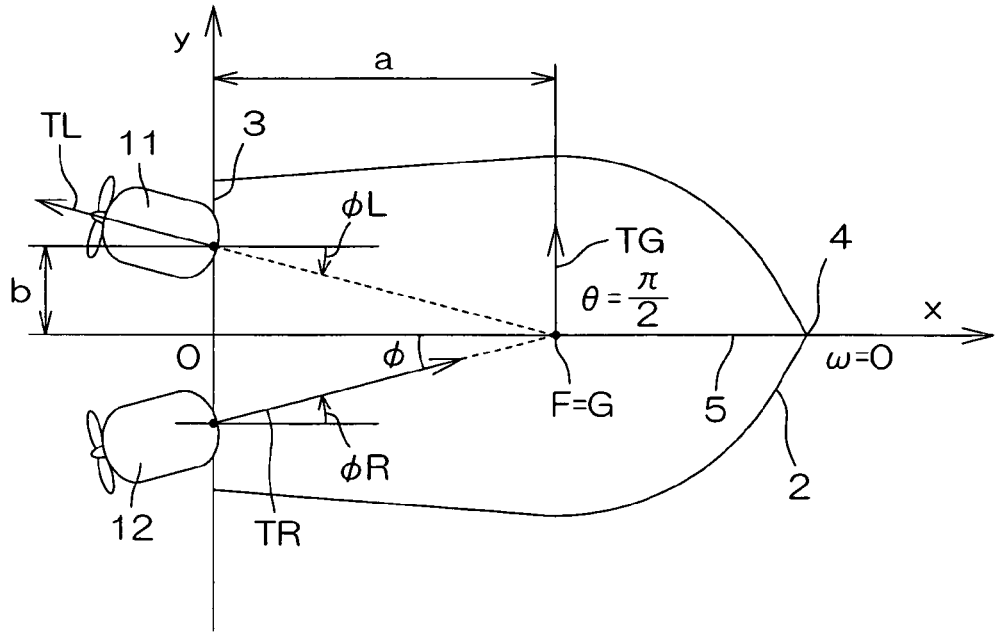
FIG. 5 is a diagram illustrating an operation for horizontally moving the hull perpendicularly to a center line of the hull.

More specifically, as shown in FIG. 5, the steering angles ϕR, ϕL are set at ϕR=ϕ, ϕL=−ϕ (wherein ϕ≧0) such that the action point F coincides with the instantaneous center G. At the same time, the port-side outboard motor 11 and the starboard-side outboard motor 12 generate the propulsive forces in the reverse drive direction and in the forward drive direction, respectively, so as to satisfy an expression |TL|=|TR|. At this time, the hull 2 is moved parallel leftward perpendicularly to a stem direction (perpendicularly to the center line 5) with the orientation of the stem 4 kept unchanged. Thus, the marine vessel 1 can move toward or away from a wharf by the lateral maneuvering operation.

When the action point F does not coincide with the instantaneous center G (see FIG. 4), a rotation moment occurs around the instantaneous center G, such that the angular speed ω of the hull 2 is not equal to zero. In other words, when the target angular speed $\omega_t$ is set at a non-zero value by the stem turning speed adjusting knob 10*b* of the lateral movement operational section 10, the steering angles ϕL, ϕR are controlled according to the target angular speed $\omega_t$ such that the action point F is offset from the instantaneous center G.

In reality, in this preferred embodiment, the steering angles ϕL, ϕR are controlled such that the angular speed ω detected by the yaw rate sensor 9 is substantially equal to the target angular speed $\omega_t$. In this case, if the angular speed ω is ω=0, the action point F coincides with the instantaneous center G with the instantaneous center G being located on the center line 5. If the angular speed ω is ω≠0, the action point F does not coincide with the instantaneous center G even with the instantaneous center G being located on the center line 5.

Figure 6:
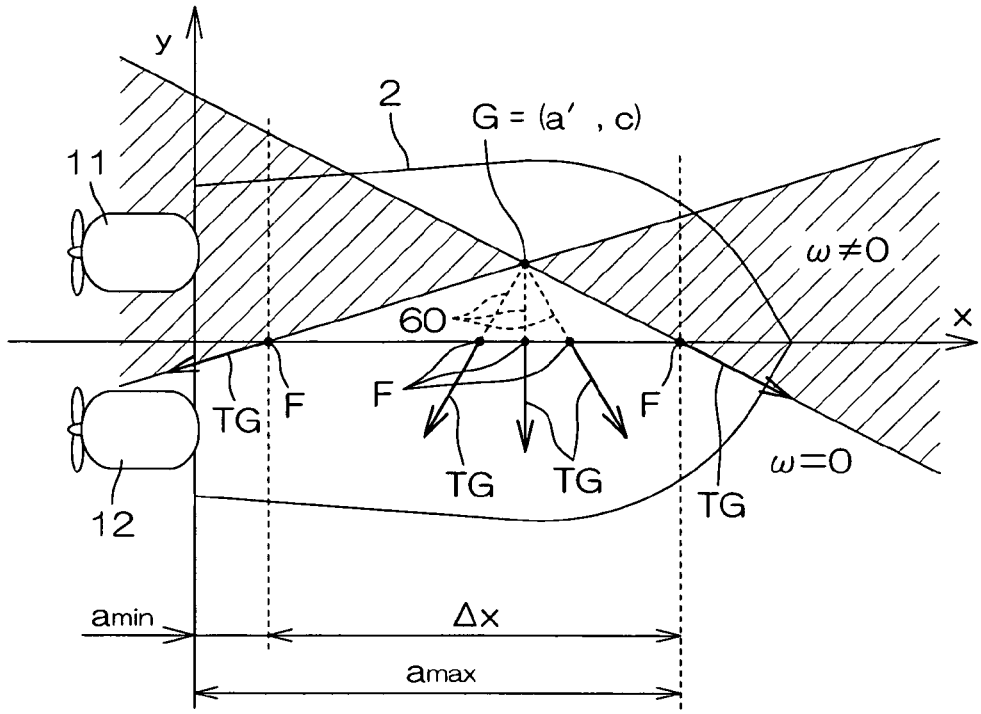
FIG. 6 is a schematic diagram for explaining a steering controlling operation.

FIG. 6 is a schematic diagram for explaining a specific operation for controlling the steering angles ϕL, ϕR. The instantaneous center G is not always located on the center line 5. In the case of the small-scale marine vessel 1, for example, the instantaneous center G changes when a crew member moves on the hull 2 or when fish are loaded into an under-deck water tank. Therefore, the position of the instantaneous center G is not limited to positions on the center line 5.

However, it is possible to perform the lateral maneuvering operation as desired with the action point F being located on the center line 5, even if the instantaneous center G is not located on the center line 5. More specifically, a line 60 extending through the instantaneous center G at the target movement angle $\theta_t$ is drawn, and the action point F is located at an intersection of the line 60 and the center line 5. Then, the magnitudes of the propulsive force vectors TL, TR for the port-side and starboard-side outboard motors 11, 12 are determined so as to provide a combined propulsive force vector TG extending from the action point F along the line 60. Thus, the hull 2 can be moved parallel with the angular speed ω being kept at ω=0.

The propulsion units 30 of the port-side and starboard-side outboard motors 11, 12 are pivotal only in a mechanically limited angular range about the steering shaft 35. Therefore, it is impossible, in reality, to locate the action point F within a range between the origin O and a predetermined lower limit point ($a_{min}$, 0) on the center line 5. Furthermore, if the action point F is located at a position more distant from the origin O than a predetermined upper limit point ($a_{max}$, 0) on the center line 5 to provide a desired combined vector TG extending laterally of the hull 2, greatly increased propulsive forces must be generated from the port-side and starboard-side outboard motors 11, 12. Therefore, the position of the action point F on the center line 5 is restricted within a range Δx between the points ($a_{min}$, 0) and ($a_{max}$, 0) due to limitations in the steering angles of the propulsion units 30 and limitations in the output capabilities of the engines 39.

Where the instantaneous center G is located at a position (a', c) in FIG. 6, for example, the aforementioned limitations make it impossible to move the hull 2 parallel from the instantaneous center G into the cross-hatched ranges shown in FIG. 6 with the action point F being located on the center line 5. That is, it is impossible to set the angular speed ω at ω=0, thereby imparting the hull 2 with a rotation moment.

Figure 7:
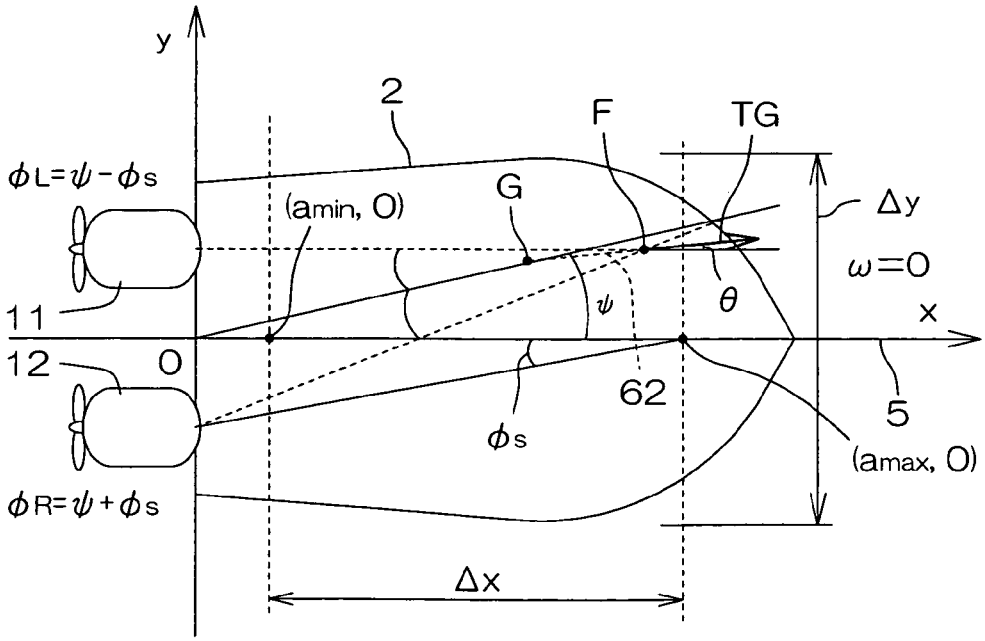
FIG. 7 is a schematic diagram for explaining the principle of an operation for locating an action point outside the center line.

That is, as shown in FIG. 7, there is a possibility that the angular speed ω cannot be set at $\omega=\omega_t$ (e.g., $\omega_t=0$) even if the steering angle ϕR is reduced to a predetermined switching reference steering angle $\phi_S$. When the steering angle ϕR is reduced to the switching reference steering angle $\phi_S$, the action point F reaches the point ($a_{max}$, 0) on the center line 5. In this case, the action point F is offset from the center line 5 in this preferred embodiment. Conversely, if the steering angles ϕL, ϕR are controlled to set the angular speed ω at ω=0, the action point F is located on a line 62 extending, through the instantaneous center G, at the target movement angle θ. Then, the outputs (propulsive forces) of the port-side and starboard-side outboard motors 11, 12 are controlled to provide a combined vector TG having a desired magnitude and a desired direction.

In general, the instantaneous center G is located within the hull 2. Therefore, it is necessary to locate the action point F within a predetermined range Δy having a width roughly equivalent to the width of the hull 2. When it is impossible to obtain the target angular speed $\omega_t$ even with the action point F being located within the predetermined range Δy, an alarm may be provided to notify the operator of this situation.

Similarly, when it is impossible to attain the target angular speed $\omega_t$ even with the action point F being located at the point ($a_{min}$, 0) on the center line 5 by increasing the steering angle ϕR, an alarm is preferably provided to notify the operator of this situation.

In the case shown in FIG. 7, the steering angles ϕL, ϕR of the port-side and starboard-side outboard motors 11, 12 are calculated from the following expression so as to simplify of the control operation.

$$\phi L=\psi-\phi_S$$

$$\phi R=\psi+\phi_S$$

wherein ψ is a steering angle correction value.

Therefore, the steering angles ϕL, ϕR are determined by properly determining the steering angle correction value ψ to attain the target angular speed $\omega_t$. Thus, the computation for the control operation is simplified. Here, the switching reference steering angle $\phi_S$ is a steering angle which is observed when the action point F is located at the point ($a_{max}$, 0) on the center line 5, and expressed by $\phi_S=\tan^{-1}(b/a_{max})$.

Referring to FIG. 4, a method for calculating the magnitudes |TL|, |TR| of the propulsive forces to be generated from the port-side and starboard-side outboard motors 11, 12 will be described in more detail.

The magnitude $|TG_t|$ of the combined target propulsive force $TG_t$ input from the lateral movement operational section 10 is determined by the mass of the entire marine vessel 1 and the degree of acceleration to be generated. It is herein assumed that the magnitude $|TR_t|$ of the target propulsive force vector $TR_t$ for the starboard-side outboard motor 12 for providing the target combined propulsive force magnitude $|TG_t|$ is calculated from the following expression (1) by multiplying the magnitude $|TL_t|$ of the target propulsive force vector $TL_t$ for the port-side outboard motor 11 by a scalar k.

$$|TL_t|=k|TR_t| \tag{1}$$

It is further assumed that the target steering angles $\phi R_t$, $\phi L_t$ of the port-side and starboard-side outboard motors 11, 12 are determined so as to satisfy an expression $\phi_t=\phi R_t=-\phi L_t$ (wherein $\phi_t$ is a target steering angle basic value) in the lateral movement mode.

Where the target combined propulsive force vector $TG_t$ is provided by combining the target propulsive force vectors $TL_t$, $TR_t$ for the port-side and starboard-side outboard motors 11, 12, x-axis and y-axis components $TG_tx$, $TG_ty$ of the target combined propulsive force vector $TG_t$ satisfy the following expressions (2) and (3):

$$TG_tx=|TG_t|\cos\theta_t=|TR_t|\cos\phi_t+|TL_t|\cos\phi_t \tag{2}$$

$$TG_ty=|TG_t|\sin\theta_t=|TR_t|\sin\phi_t-|TL_t|\sin\phi_t \tag{3}$$

Then, the magnitude $|TR_t|$ of the target propulsive force vector $TR_t$ for the starboard-side outboard motor 12 is expressed by the following expression (4):

$$|TR_t|=\frac{|TG_t|(\cos\theta_t+\sin\theta_t)}{\{(1+k)\cos\phi_t+(1-k)\sin\phi_t\}} \tag{4}$$

On the other hand, the following expression (5) is obtained from the expressions (2) and (3).

$$\tan\theta_t=\frac{|T_R|-|T_L|}{|T_R|+|T_L|}\cdot\frac{\sin\phi_t}{\cos\phi_t}=\frac{|T_R|-|T_L|}{|T_R|+|T_L|}\cdot\tan\phi_t \tag{5}$$

The expression (1) is substituted in the expression (5) to provide the following expression (6).

$$\tan\theta_t=\frac{1-k}{1+k}\cdot\tan\phi_t \tag{6}$$

By solving this equation, the factor k is expressed by the following expression (7):

$$k = \frac{\tan\phi_t - \tan\theta_t}{\tan\phi_t + \tan\theta_t} \quad (7)$$

Therefore, the factor k is calculated from the expression (7) based on the target steering angle basic value $\phi_t$ ($=\phi R_t$) and the target movement angle $\theta_t$. The target propulsive force $|TR_t|$ for the starboard-side outboard motor 12 is calculated from the expression (4) based on the factor k, the target steering angle basic value $\phi_t$, the target movement angle $\theta_t$ and the target combined propulsive force $|TG_t|$. Further, the target propulsive force $|TL_t|$ for the port-side outboard motor 11 is calculated from the expression (1).

Therefore, the target propulsive forces $|TL_t|$, $|TR_t|$ for the port-side and starboard-side outboard motors 11, 12 are determined based on the input of the target steering angle basic value $\phi_t$ (which may be a value detected by the steering angle sensor 49), the target movement angle $\theta_t$ and the target combined propulsive force $|TG_t|$ through a computation process performed by the microcomputer.

However, when the target movement angle $\theta_t$ is $\theta_t=-\pi/4$ or $3\pi/4$ (rad), it is impossible to calculate the target propulsive force $|TR_t|$ from the expression (4) with the right side of the expression (4) being 0/0. Therefore, the target propulsive forces $|TL_t|$, $|TR_t|$ for different target movement angles $\theta_t$ from 0 to $2\pi$ in increments of $\pi/36$ are preliminarily calculated based on different target steering angle basic values $\phi_t$ and different target combined propulsive forces $|TG_t|$, and the results of the calculation are stored in the form of a map, which is used for the control of the propulsive forces.

If the action point F is offset from the center line 5 as shown in FIG. 7, the relationship $\phi L=-\phi R=-\phi$ is not satisfied. Even in this case, the aforementioned map is useful. This is because the target steering angles $\phi L_t$, $\phi R_t$ are determined from the expression $\phi L_t=\psi_t-\phi_S$ and $\phi R_t=\psi_t+\phi_S$. More specifically, the target steering angle basic value $\phi_t$ and the target movement angle $\theta_t$ are replaced with a target steering angle input value $\phi R_t-\psi_t$ (or $\phi_t \leftarrow \phi R-\psi_t$) and a target movement angle input value $\theta_t-\psi_t$, respectively, when the map is used.

Figure 8:
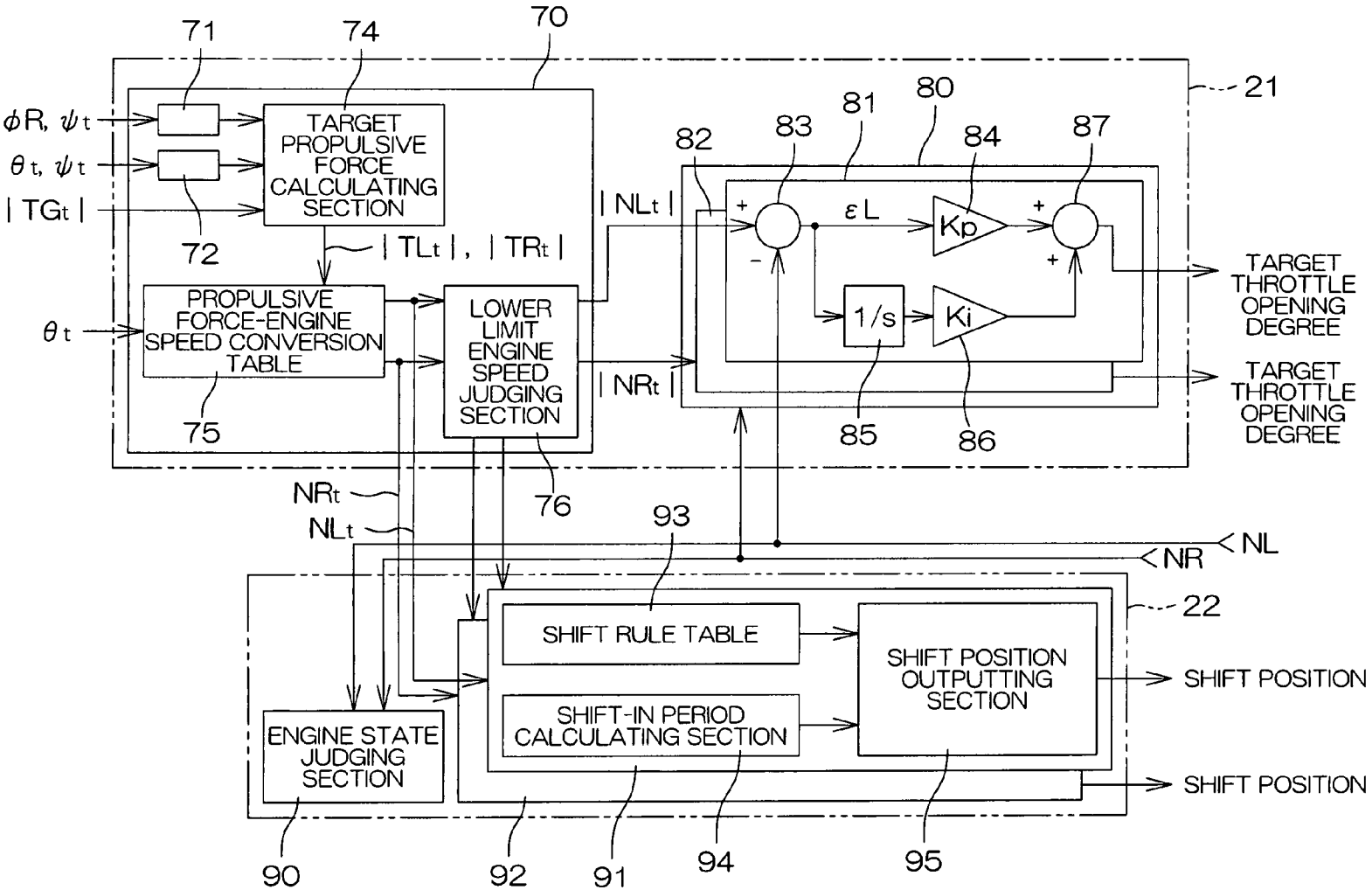
FIG. 8 is a block diagram illustrating the functions of a throttle controlling section and a shift controlling section, particularly, for explaining control operations to be performed by the throttle controlling section and the shift controlling section in the lateral movement mode.

FIG. 8 is a block diagram illustrating the function of the throttle controlling section 21 and the shift controlling section 22, particularly, for explaining control operations to be performed by the throttle controlling section 21 and the shift controlling section 22 in the lateral movement mode. The throttle controlling section 21 includes a target engine speed calculating module 70 (target propulsive force calculating section) which calculates target engine speeds $|NL_t|$, $|NR_t|$ of the engines 39 of the port-side and starboard-side outboard motors 11, 12, and a throttle opening degree calculating module 80 (propulsive force controlling section) which calculates the target throttle opening degrees of the engines 39 of the outboard motors 11, 12 based on the calculated target engine speeds $|NL_t|$, $|NR_t|$.

The target engine speed calculating module 70 includes a steering angle input value calculating section 71 which receives the steering angle $\phi R$ (or the target steering angle $\phi R_t$) of the starboard-side outboard motor 12 and the target steering angle correction value $\psi_t$ from the steering controlling section 23 and calculates the steering angle input value $\phi R-\psi_t$ (or $\phi R_t-\psi_t$) to be used in a map search, and a target movement angle input value calculating section 72 which calculates the target movement angle input value $\theta_t-\psi_t$ to be used in the map search based on the target movement angle $\theta_t$ and the target steering angle correction value $\psi_t$ from the lateral movement operational section 10. The target engine speed calculating module 70 further includes a target propulsive force calculating section 74 which calculates the target propulsive forces $|TL_t|$, $|TR_t|$ of the port-side and starboard-side outboard motor 11, 12, a propulsive force-to-engine speed conversion table 75 which determines the target engine speeds $NL_t$, $NR_t$ (with signs indicating the directions of the propulsive forces to be generated) of the port-side and starboard-side outboard motors 11, 12 for the target propulsive forces $|TL_t|$, $|TR_t|$, and a lower limit engine speed judging section 76 which calculates the absolute values $|NL_t|$, $|NR_t|$ of the target engine speeds and compares the absolute values $|NL_t|$, $|NR_t|$ with the lower limit engine speed (which is, for example, equal to the idle speed of the engines 39).

The target propulsive force calculating section 74 is defined by the aforementioned map which outputs the target propulsive forces $|TL_t|$, $|TR_t|$ of the port-side and starboard-side outboard motors 11, 12 based on the steering angle input value $\phi R-\psi_t$ (or $\phi R_t-\psi_t$), the target movement angle input value $\theta_t-\psi_t$ and the target combined propulsive force $|TG_t|$ applied from the lateral movement operational section 10.

The target propulsive forces $|TL_t|$, $|TR_t|$ are not suitable for the control of the engines 39 and, therefore, are converted into the target engine speeds $NL_t$, $NR_t$ according to the characteristics of the engines 39 with reference to the propulsive force-to-engine speed conversion table 75. The signs of the target engine speeds $NL_t$, $NR_t$ are determined according to the target movement angle $\theta_t$. More specifically, if the target movement angle $\theta_t$ is $0 \leqq \theta_t \leqq \pi$, a minus sign indicating the reverse drive direction is assigned to the target engine speed $NL_t$ of the port-side outboard motor 11, and a plus sign indicating the forward drive direction is assigned to the target engine speed $NR_t$ of the starboard-side outboard motor 12. On the other hand, if the target movement angle $\theta_t$ is $\pi \leqq \theta_t < 2\pi$ (or $-\pi < \theta_t < 0$), a plus sign indicating the forward drive direction is assigned to the target engine speed $NL_t$ of the port-side outboard motor 11, and a minus sign indicating the reverse drive direction is assigned to the target engine speed $NR_t$ of the starboard-side outboard motor 12. The target engine speeds $NL_t$, $NR_t$ thus determined are input not only to the lower limit engine speed judging section 76 (rotational speed comparing section), but also to the shift controlling section 22.

The lower limit engine speed judging section 76 determines whether the absolute values $|NL_t|$, $|NR_t|$ of the target engine speeds are less than the lower limit engine speed NLL (which is equal to the idle speed), and applies judgment results to the shift controlling section 22. Further, the absolute values $|NL_t|$, $|NR_t|$ of the target engine speeds are applied to the throttle opening degree calculating module 80. However, if the target engine speed $|NL_t|$ of the port-side outboard motor 11 is less than the lower limit engine speed NLL, the lower limit engine speed judging section 76 substitutes the lower limit engine speed NLL for the target engine speed $|NL_t|$. Similarly, if the target engine speed $|NR_t|$ of the starboard-side outboard motor 12 is less than the lower limit engine speed NLL, the lower limit engine speed judging section 76 substitutes the lower limit engine speed NLL for the target engine speed $|NR_t|$.

The throttle opening degree calculating module 80 includes a port-side PI (proportional integration) control module 81 and a starboard-side PI control module 82, which have substantially the same construction. The port-side PI control module 81 receives the target engine speed $|NL_t|$ of the port-side outboard motor 11 input from the lower limit engine speed judging section 76, and a current engine speed NL (≧0) input from the outboard motor ECU 13 of the port-side outboard motor 11. A deviation $\epsilon L=|NL_t|-NL$ of the current engine speed NL from the target engine speed $|NL_t|$ of the port-side outboard motor 11 is calculated by a deviation computing section 83. The deviation $\epsilon L$ is output from the deviation computing section 83 to a proportional gain multiplying section 84, and to an integrating section 85 in which the deviation $\epsilon L$ is subjected to a discrete integration process. The integration result provided by the integrating section 85 is applied to an integration gain multiplying section 86. The proportional gain multiplying section 84 outputs a value obtained by multiplying the deviation $\epsilon L$ by a proportional gain kp, and the integration gain multiplying section 86 outputs a value obtained by multiplying the integration value of the deviation $\epsilon L$ by an integration gain ki. These values are added by the adding section 87 to provide a target throttle opening degree of the engine 39 of the port-side outboard motor 11. The target throttle opening degree is applied to the outboard motor ECU 13 of the port-side outboard motor 11. The port-side PI control module 81 thus performs a so-called PI (proportional integration) control.

The starboard-side PI control module 82 has substantially the same construction as the port-side PI control module 81. That is, the starboard-side PI control module 82 processes a deviation $\epsilon R$ of a current engine speed NR (≧0) from the target engine speed $|NR_t|$ of the starboard-side outboard motor 12 through the PI (proportional integration) control, and outputs a target throttle opening degree of the engine 39 of the starboard-side outboard motor 12. The target throttle opening degree is applied to the outboard motor ECU 14 of the starboard-side outboard motor 12.

The shift controlling section 22 includes a port-side shift control module 91 and a starboard-side shift control module 92, which have substantially the same construction. Each of the shift control modules 91, 92 generate a shift controlling signal for controlling the shift mechanism 43 (more specifically, the dog clutch 43*d*) of the outboard motor 11, 12 based on the target engine speed $NL_t$, $NR_t$ applied from the propulsive force-to-engine speed conversion table 75 to switch the shift position of the shift mechanism 43 to the forward drive position, the reverse drive position or the neutral position. Each of the shift control modules 91, 92 perform the intermittent shift control operation (intermittent coupling control operation) for periodically switching the shift position of the shift mechanism 43 alternately between the neutral position and the forward drive position or between the neutral position and the reverse drive position to intermittently couple the engine 39 to the propeller 40 when the target engine speed $NL_t$, $NR_t$ is less than the lower limit engine speed NLL.

The intermittent shift control operation will hereinafter be referred to as "PWM control" (pulse width modulation control). In a shift-in period $S_{in}$ of a PWM control period S, the rotation of the engine 39 is transmitted to the propeller shaft 42 with the shift position being set at the forward drive position or the reverse drive position. In a neutral period $S-S_{in}$ of the PWM control period S, the shift position is set at the neutral position.

The port-side shift control module 91 includes a shift rule table 93 which outputs the shift position (the forward drive position, the reverse drive position or the neutral position) of the shift mechanism 43 based on the sign of the target engine speed $NL_t$ of the port-side outboard motor 11 applied from the propulsive force-to-engine speed conversion table 75. The port-side shift control module 91 further includes a shift-in period calculating section 94 (coupling duration calculating section) which calculates the shift-in period $S_{in}$ based on the absolute value $|NL_t|$ of the target engine speed $NL_t$ applied from the propulsive force-to-engine speed conversion table 75. The port-side shift control module 91 further includes a shift position outputting section 95 (intermittent coupling controlling section) which generates a shift position signal indicating the shift position of the shift mechanism 43 of the port-side outboard motor 11 based on the outputs of the shift rule table 93 and the shift-in period calculating section 94.

The shift rule table 93 outputs a signal indicating the forward drive position when the target engine speed $NL_t$ has a plus sign, and outputs a signal indicating the reverse drive position when the target engine speed $NL_t$ has a minus sign. Where the absolute value of the target engine speed $NL_t$ is determined to be substantially zero (for example, not higher than about 100 rmp), the shift rule table 93 outputs a signal indicating the neutral position.

The shift-in period calculating section 94 sets the shift-in period $S_{in}$ at $S_{in}=S$ if the lower limit engine speed judging section 76 determines that the target engine speed $NL_t$ is not less than the lower limit engine speed NLL. In this case, the PWM control is not performed, but the shift position of the shift mechanism 43 is maintained at the shift position output from the shift rule table 93. On the other hand, if the lower limit engine speed judging section 76 determines that the target engine speed $NL_t$ is less than the lower limit engine speed NLL, the shift-in period calculating section 94 sets the shift-in period $S_{in}$ at $S_{in}=S\cdot D$ wherein $D=NL_t/NLL$ is a duty ratio for the PWM control.

The shift position outputting section 95 outputs the shift position signal in a cycle of the PWM period S. More specifically, the shift position outputting section 95 continuously generates the shift position signal according to the output of the shift rule table 93 over the shift-in period $S_{in}$ calculated by the shift-in period calculating section 94 in the PWM period S, and generates the shift position signal indicating the neutral position in the neutral period irrespective of the output of the shift rule table 93. If the shift-in period $S_{in}$ is $S_{in}=S$, the shift position signal according to the output of the shift rule table 93 is continuously output.

The starboard-side shift control module 92 has substantially the same construction as the port-side shift control module 91, and controls the shift position of the shift mechanism 43 of the starboard-side outboard motor 12 by performing the aforementioned operation based on the target engine speed $NR_t$ of the starboard-side out board motor 12 and the judgment result on the absolute value of the target engine speed $NR_t$ provided by the lower limit engine speed judging section 76.

The engines 39 of the outboard motors 11, 12 are each intrinsically inoperative at an engine speed less than the lower limit engine speed NLL, such that an output less than the lower limit engine speed NLL is not provided. In this preferred embodiment, therefore, if the target engine speeds $NL_t$, $NR_t$ are each set to have an absolute value that is less than the lower limit engine speed NLL, the engines 39 are each operated at the lower limit engine speed NLL, and the rotation thereof is intermittently transmitted to the propeller 40 at the duty ratio D which depends upon the target engine speed $NL_t$, $NR_t$. Thus, the propulsive force can be provided for an engine speed that is less than the idle speed NLL.

The shift controlling section 22 further includes an engine state judging section 90 (motor state judging section) for judging whether the engines 39 of the port-side and starboard-side outboard motors 11, 12 are inactive in the lateral movement mode. The engine state judging section 90 acquires the engine speeds NL, NR of the engines 39 of the port-side and starboard-side outboard motors 11, 12 from the outboard motor ECUs 13, 14. Then, the engine state judging section 90 judges whether the engines 39 are active based on whether or not the engine speeds NL, NR are substantially zero. If at least one of the engines 39 of the outboard motors 11, 12 is inactive in the lateral movement mode, a signal indicating the inactive engine state is applied to the shift position outputting sections 95 of the shift control modules 91, 92. In response to this signal, each of the shift position outputting sections 95 controls the shift mechanism 43 of the outboard motor 11, 12 to switch the shift position of the shift mechanism 43 to the neutral position.

The engine state judging section 90 also functions as a restart controlling section for controlling the restart of the engines 39. That is, when the engine state judging section 90 determines that at least one of the engines 39 of the outboard motors 11, 12 is inactive in the lateral movement mode, the engine state judging section 90 provides a command to the outboard motor ECU 13, 14 of the corresponding outboard motor 11, 12 to restart the inactive engine 39. In response to the command, the outboard motor ECU 13, 14 actuates the starter motor 45 of the inactive engine 39.

The engine state judging section 90 monitors the engine speeds NL, NR to determine whether the inactive engine 39 is restarted. When the engines 39 of the respective outboard motors 11, 12 become active after the restart of the inactive engine 39, a signal indicating the engine active state is applied to the shift position outputting sections 95. In response to this signal, the shift position outputting sections 95 of the shift control modules 91, 92 are each returned to an ordinary state to control the shift mechanism 43 according to the outputs of the shift rule table 93 and the shift-in period calculating section 94.

Figure 9:
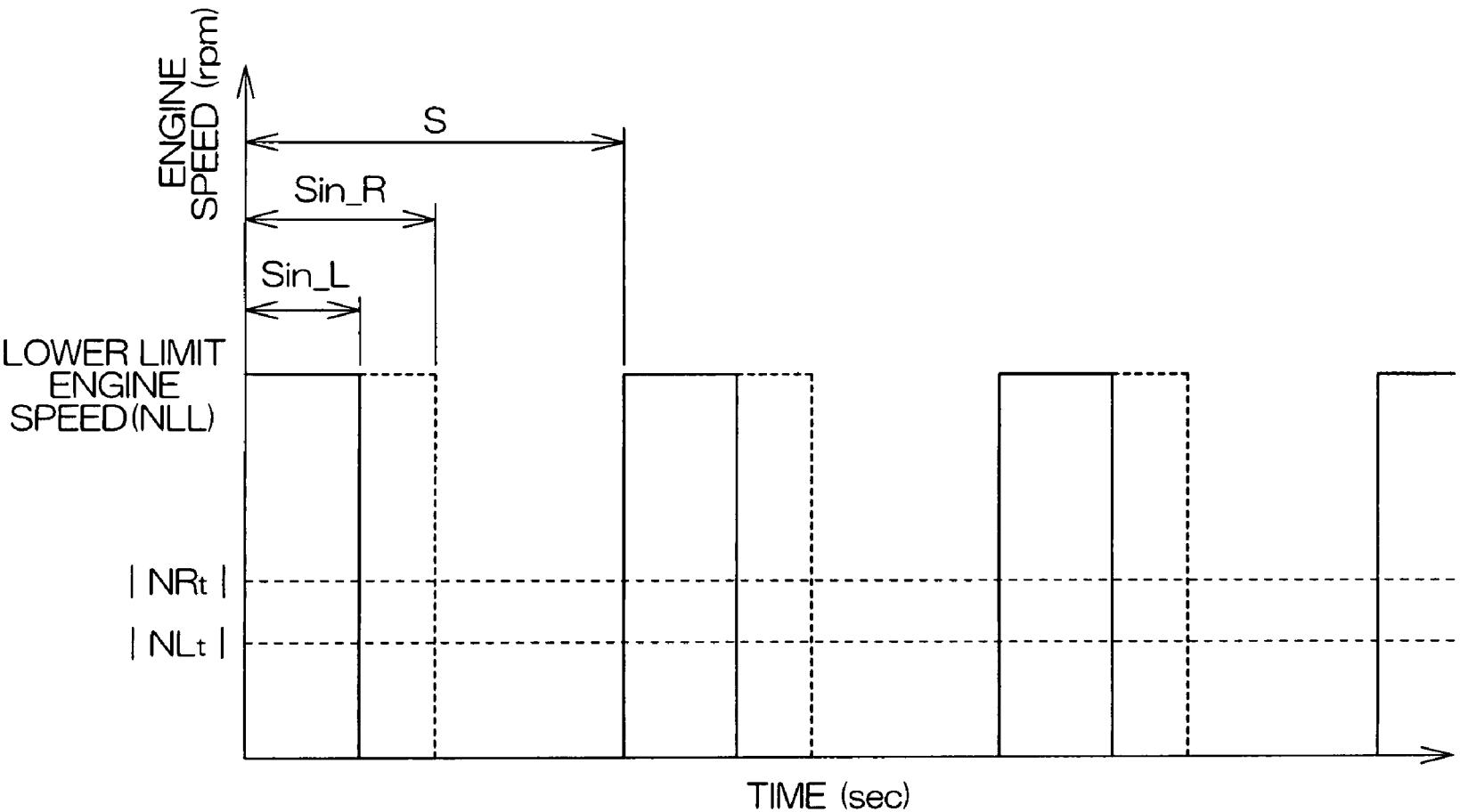
FIG. 9 is a timing chart of PWM operations to be performed by a port-side shift control module and a starboard-side shift control module.

FIG. 9 is a timing chart of the PWM operation to be performed by the port-side shift control module 91 and the starboard-side shift control module 92. In FIG. 9, solid lines indicate a change in the shift position of the shift mechanism 43 of the port-side outboard motor 11 to be controlled by the port-side shift control module 91, and broken lines indicate a change in the shift position of the shift mechanism 43 of the starboard-side outboard motor 12 to be controlled by the starboard-side shift control module 92.

Herein, it is assumed that the absolute values of the target engine speeds $NL_t$, $NR_t$ of the port-side and starboard-side outboard motors 11, 12 are less than the lower limit engine speed (idle speed) NLL. At this time, the shift-in period calculating sections 94 provided in the port-side shift control module 91 and the starboard-side shift control module 92 respectively calculate shift-in periods $S_{in}$_L and $S_{in}$_R. Therefore, the dog clutch 43*d* of the port-side outboard motor 11 is located at the forward drive position or the reverse drive position over the shift-in period $S_{in}$_L in the PWM period S, and located at the neutral drive position in a neutral period S−$S_{in}$_L. Similarly, the dog clutch 43*d* of the starboard-side outboard motor 12 is located at the forward drive position or the reverse drive position over the shift-in period $S_{in}$_R in the PWM period S, and located at the neutral drive position in a neutral period (S−$S_{in}$_R). In the shift-in periods $S_{in}$_L, $S_{in}$_R, the rotation of each of the engines 39 rotating at the lower limit engine speed NLL are transmitted to the corresponding propellers 40.

In this preferred embodiment, the PWM shift control operations performed by the shift position outputting sections 95 of the port-side and starboard-side shift control modules 91, 92 are synchronized with each other. That is, as shown in FIG. 9, the shift-in timings in the PWM shift control operations are synchronized in each PWM period. Thus, the on-board comfort is improved in the PWM control. Of course, the required propulsive forces can be generated from the respective outboard motors 11, 12 without synchronization of the PWM shift control operations. However, the lag of the shift timings of the port-side and starboard-side outboard motors 11, 12 results in poorer on-board comfort.

Figure 10:
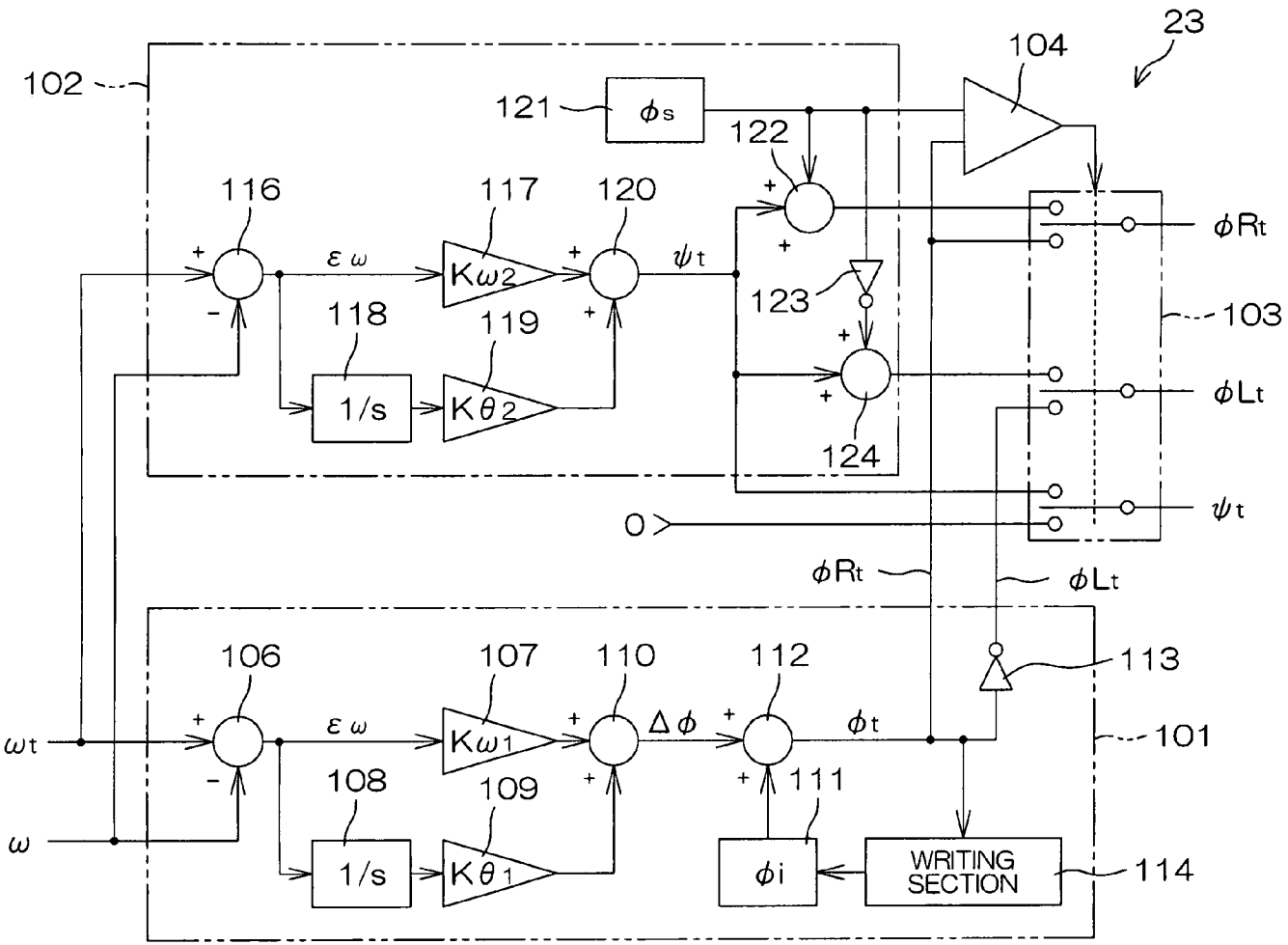
FIG. 10 is a block diagram illustrating the functions of a steering controlling section, particularly, for explaining a control operation to be performed by the steering controlling section in the lateral movement mode.

FIG. 10 is a block diagram illustrating the function of the steering controlling section 23, and particularly, for explaining a control operation to be performed by the steering controlling section 23 in the lateral movement mode. The steering controlling section 23 includes a first target steering angle computing section 101 (target steering angle calculating section) which computes the target steering angles $\phi R_t$, $\phi L_t$ to be set when the action point F is located on the center line 5, a second target steering angle computing section 102 (target steering angle calculating section) which computes the target steering angle $\phi R_t$, $\phi L_t$ to be set when the action point F is located outside of the center line 5, a selector 103 which selects outputs of either of the first target steering angle computing section 101 and the second target steering angle computing section 102, and a comparing section 104 which controls switching of the selector 103.

The comparing section 104 compares the target steering angle $\phi R_t$ of the starboard-side outboard motor 12 computed by the first target steering angle computing section 101 with the switching reference steering angle $\phi_S$ ($=\tan^{-1}(b/a_{max})$. That is, if the target steering angle $\phi R_t$ of the starboard-side outboard motor 12 computed by the first target steering angle computing section 101 is not less than the switching reference steering angle $\phi_S$, the comparing section 104 controls the selector 103 to select the outputs of the first target steering angle computing section 101. On the other hand, if the target steering angle $\phi R_t$ of the starboard-side outboard motor 12 computed by the first target steering angle computing section 101 is less than the switching reference steering angle $\phi_S$, the comparing section 104 controls the selector 103 to select the outputs of the second target steering angle computing section 102.

The first target steering angle computing section 101 is defined by a PI (proportional integration) control module based on the input of the angular speed ω detected by the yaw rate sensor 9 and the target angular speed $\omega_t$ applied from the lateral movement operational section 10. That is, the first target steering angle computing section 101 is operative so as to set the angular speed ω so as to be substantially equal to the target angular speed $\omega_t$ through PI control. More specifically, the first target steering angle computing section 101 includes a deviation computing section 106 which computes a deviation $\epsilon_\omega$ of the angular speed ω from the target angular speed $\omega_t$, a proportional gain multiplying section 107 which multiplies the output $\epsilon_\omega$ of the deviation computing section 106 by a proportional gain $k_{\omega 1}$, an integrating section 108 which integrates the deviation $\epsilon_\omega$ output from the deviation computing section 106, an integration gain multiplying section 109 which multiplies the output of the integrating section 108 by an integration gain $k_{\theta 1}$, and a first adding section 110 which generates a steering angle deviation Δϕ by adding the output of the proportional gain multiplying section 107 and the output of the integration gain multiplying section 109. These components define a steering angle deviation computing section.

Further, the first target steering angle computing section 101 includes a memory 111 (basic target steering angle storing section) which stores an initial target steering angle $\phi i$ as a basic target steering angle, and a second adding section 112 (adding section) which determines the target steering angle basic value $\phi_t$ ($=\phi i+\Delta\phi$) by adding the steering angle deviation $\Delta\phi$ generated by the first adding section 110 to the initial target steering angle $\phi i$ stored in the memory 111. The target steering angle basic value $\phi_t$ is used as the target steering angle $\phi R_t$ of the starboard-side outboard motor 12. Further, the sign of the target steering angle basic value $\phi_t$ is reversed by a reversing section 113 to provide a value $-\phi_t$ which is used as the target steering angle $\phi L_t$ of the port-side outboard motor 11.

The memory 111 is a nonvolatile rewritable memory, such as a flash memory or an EEPROM (electrically erasable programmable read only memory). The initial target steering angle $\phi i$ is written in the memory 111, for example, by a special inputting device prior to delivery of the marine vessel 1 from a dealer to a user. The initial target steering angle $\phi i$ is set at $\phi i=\tan^{-1}(b/a_i)$ based on a design instantaneous center $Gi(a_i,0)$ which is determined by the type of the hull 2 and the outboard motors 11, 12. The instantaneous center $Gi(a_i,0)$ may be experimentally determined by test cruising.

Parameters $a_i$ and b for the initial target steering angle $\phi i$ may be stored as initial target steering angle information in the memory 111. In this case, the initial target steering angle $\phi i$ is calculated from an expression $\phi i=\tan^{-1}(b/a_i)$.

In this preferred embodiment, a learning function is provided for learning the fluctuation of the instantaneous center G dependant upon a change in the load on the marine vessel 1 and other factors. That is, a writing section 114 is provided for updating the initial target steering angle $\phi i$ in the memory 111. The writing section 114 writes the target steering angle basic value $\phi_t$ generated by the second adding section 112 as a new initial target steering angle $\phi i$ in the memory 111 when the running control is terminated by stopping the driving of the outboard motors 11, 12 or when the control mode is switched from the lateral movement mode to the ordinary running mode.

The second target steering angle computing section 102 is also defined by a PI (proportional integration) control module based on the input of the angular speed $\omega$ detected by the yaw rate sensor 9 and the target angular speed $\omega_t$ applied from the lateral movement operational section 10. That is, the second target steering angle computing section 102 sets the angular speed $\omega$ so as to be substantially equal to the target angular speed $\omega_t$ through PI control. More specifically, the second target steering angle computing section 102 includes a deviation computing section 116 which computes a deviation $\epsilon_\omega$ of the angular speed $\omega$ from the target angular speed $\omega_t$, a proportional gain multiplying section 117 which multiplies the output $\epsilon_\omega$ of the deviation computing section 116 by a proportional gain $k_{\omega 2}$, an integrating section 118 which integrates the deviation $\epsilon_\omega$ output from the deviation computing section 116, an integration gain multiplying section 119 which multiplies the output of the integrating section 118 by an integration gain $k_{\theta 2}$, and a first adding section 120 which generates a target steering angle correction value $\psi_t$ by adding the output of the proportional gain multiplying section 117 and the output of the integration gain multiplying section 119. The second target steering angle computing section 102 further includes a memory 121 which stores the switching reference steering angle $\phi_S$, a second adding section 122 which determines the target steering angle $\phi R_t$ ($=\phi_S+\psi_t$) of the starboard-side outboard motor 12 by adding the switching reference steering angle $\phi_S$ stored in the memory 121 to the target steering angle correction value $\psi_t$ generated by the first adding section 120, a reversing section 123 which reverses the sign of the switching reference steering angle $\phi_S$ to provide an reversed value $-\phi_S$, and a third adding section 124 which provides the target steering angle $\phi L_t$ ($=-\phi_S+\psi_t$) of the port-side outboard motor 11 by adding the target steering angle correction value $\psi_t$ to the value $-\phi_S$ provided by the reversing section 123. The switching reference steering angle $\phi_S$ is also applied to the comparing section 104 from the memory 121.

Further, the selector 103 selectively outputs the target steering angle correction value $\psi_t$ provided by the first adding section 120 or zero.

With this arrangement, if it is possible to attain the target angular speed $\psi_t$ by moving the action point F in the predetermined range $\Delta x$ ($x=a_{min}$ to $a_{max}$, see FIG. 7) on the center line 5, the selector 103 selects the target steering angles $\phi L_t$, $\phi R_t$ provided by the first target steering angle computing section 101, and applies the target steering angles $\phi L_t$, $\phi R_t$ to the outboard motor ECUs 13, 14. At this time, the target steering angles $\phi L_t$, $\phi R_t$ of the port-side and starboard-side outboard motors 11, 12 satisfy the relationship $\phi L_t=-\phi R_t$. Further, the selector 103 outputs $\psi_t=0$ as the target steering angle correction value $\psi_t$ to be used for the computation in the throttle controlling section 21.

On the other hand, if it is not possible to attain the target angular speed $\omega_t$ by moving the action point F in the predetermined range $\Delta x$ on the center line 5, the target steering angle $\phi R_t$ becomes less than the switching reference steering angle $\phi_S$ ($\phi R_t<\phi_S$) when the action point F reaches the endpoint ($a_{max}$, 0) of the range $\Delta x$. Therefore, the selector 103 selects the output of the second target steering angle computing section 102. Thus, the target steering angles $\phi L_t$, $\phi R_t$ based on the switching reference steering angle $\phi_S$ are set for the port-side and starboard-side outboard motors 11, 12, such that the action point F is located outside the center line 5. Further, the selector 103 outputs the value provided by the first adding section 120 as the target steering angle correction value $\psi_t$ to be used for the computation in the throttle controlling section 21.

Figure 11:
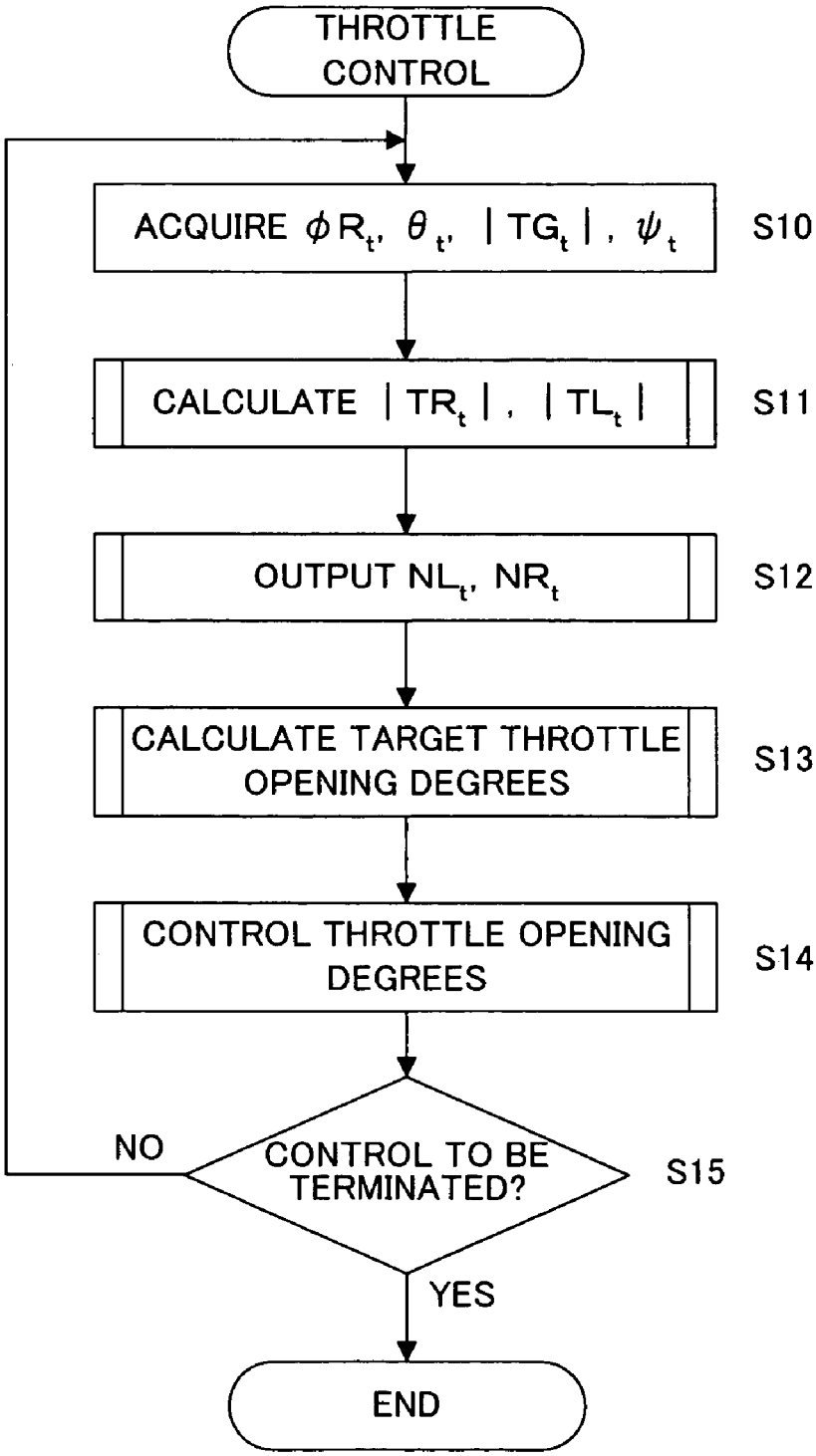
FIG. 11 is a flow chart for explaining a throttle controlling operation.

FIG. 11 is a flow chart for explaining a throttle controlling operation to be performed by the throttle controlling section 21. The target engine speed calculating module 70 acquires the starboard-side target steering angle $\phi R_t$ (or the actually detected steering angle $\phi R$) and the target steering angle correction value $\psi_t$ from the steering controlling section 23, and acquires the target movement angle $\theta_t$ and the target combined propulsive force $|TG_t|$ from the lateral movement operational section 10 (Step S10).

The target propulsive forces $|TL_t|$, $|TR_t|$ of the port-side and starboard-side outboard motors 11, 12 are calculated based on the starboard-side target steering angle $\phi R_t$, the target steering angle correction value $\psi_t$, the target movement angle $\theta_t$ and the target combined propulsive force $|TG_t|$ primarily by the operation of the target propulsive force calculating section 74 (Step S11). Further, the target engine speeds $NL_t$, $NR_t$ are determined according to the target propulsive forces $|TL_t|$, $|TR_t|$ and the target movement angle $\theta_t$ by the propulsive force-to-engine speed conversion table 75 (if the absolute values of the target engine speeds $NL_t$, $NR_t$ are less than the lower limit engine speed NLL, the target engine speeds $NL_t$, $NR_t$ are each set at the lower limit engine speed NLL) (Step S12). Throttle opening degree commands are generated based on the target engine speeds $NL_t$, $NR_t$ primarily by the operation of the throttle opening degree calculating module 80, and applied to the outboard motor ECUs 13, 14 (Step S13). According to the applied throttle opening degree commands, the outboard motor ECUs 13, 14 control the respective throttle actuators 52

(Step S14). In this manner, the throttle opening degrees of the engines 39 of the respective outboard motors 11, 12 are controlled, whereby the engine speeds of the engines 39 are controlled. Thus, the port-side and starboard-side outboard motors 11, 12 generate the target propulsive forces $|TL_t|$, $|TR_t|$, respectively.

The throttle controlling section 21 determines whether the control operation in the lateral movement mode is to be continued (Step S15). This judgment is based on whether the operation of the lateral movement operational section 10 is continued, i.e., whether a significant input from the lateral movement operational section 10 is detected. If a significant input from the steering operational section 7 or the throttle operational section 8 is detected, the control operation from Step S10 to Step S14 is terminated to return the control mode to the ordinary running mode from the lateral movement mode. If the control operation in the lateral movement mode is continued, the process beginning from Step S10 is repeated.

Figure 12:
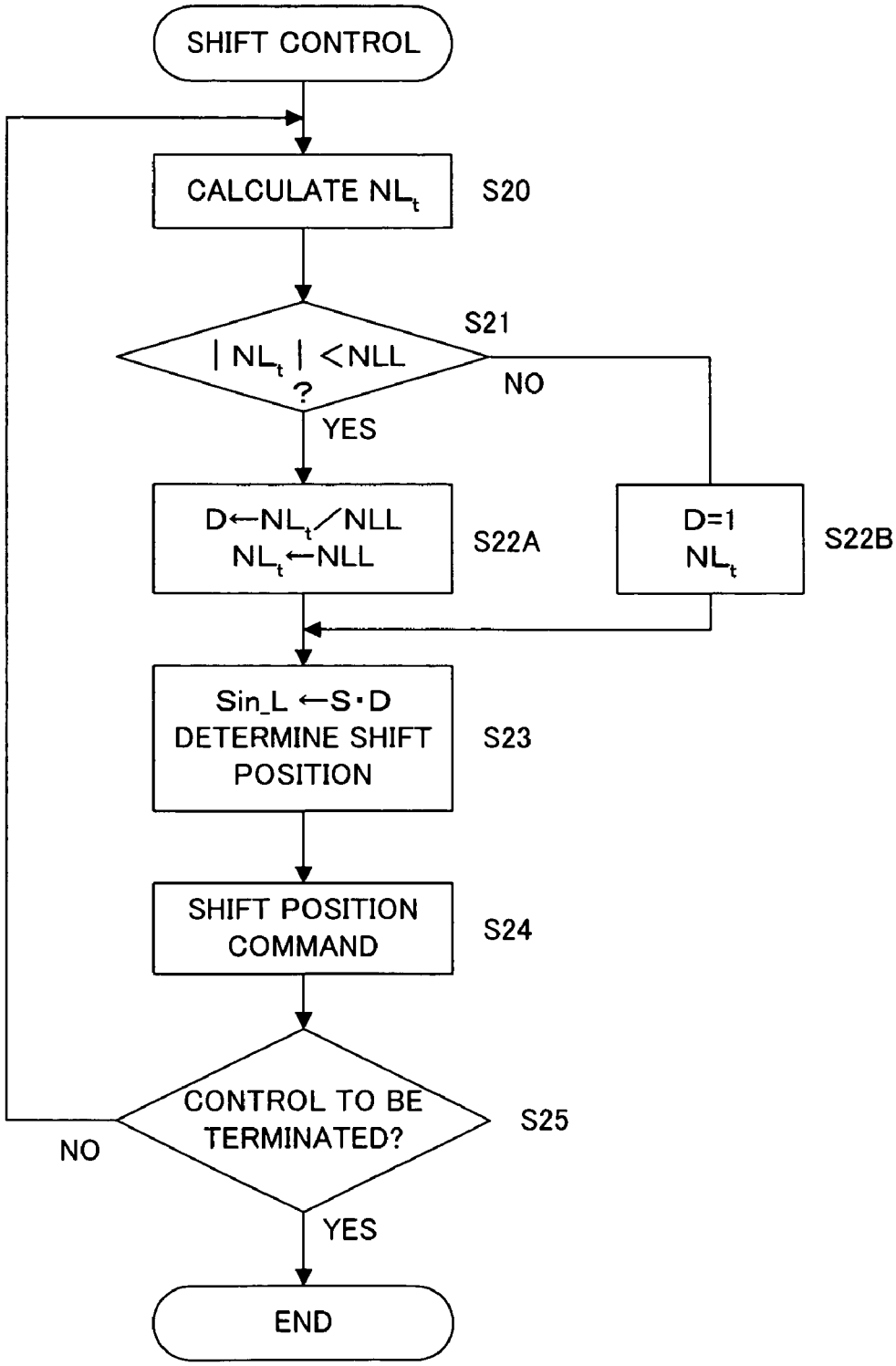
FIG. 12 is a flow chart for explaining an operation for controlling a shift mechanism of a port-side outboard motor.

FIG. 12 is a flow chart for explaining a control operation for controlling the shift mechanism 43 of the port-side outboard motor 11. When the target engine speed $NL_t$ is provided by the propulsion force-to-engine speed conversion table 75 (Step S20), the lower limit engine speed judging section 76 compares the absolute value $|NL_t|$ of the target engine speed $NL_t$ with the lower limit engine speed NLL (Step S21). If the target engine speed $NL_t$ is less than the lower limit engine speed NLL, the shift-in period calculating section 94 of the shift controlling section 22 sets the duty ratio D at $D=NL_t/NLL$, and the lower limit engine speed judging section 76 inputs the target engine speed $NL_t$ having an absolute value replaced with the value of the lower limit engine speed NLL to the throttle opening degree calculating module 80 (the port-side PI control module 81) (Step S22A).

The shift-in period calculating section 94 calculates the shift-in period $S_{in}=S\cdot D$ (Step S23). Further, the shift position is determined according to the target engine speed $NL_t$ by the shift rule table 93 (Step S23). Based on the shift-in period $S_{in}$ and the shift position, a shift position command is output from the shift position outputting section 95 (Step S24). The outboard motor ECU 13 controls the shift actuator 52 based on the shift position command.

If the target engine speed $NL_t$ is not less than the lower limit engine speed NLL (Step S21), the shift-in period calculating section 94 sets the duty ratio D at D=1, and the lower limit engine speed judging section 76 inputs the target engine speed $NL_t$ as is to the throttle opening degree calculating module 80 (the port-side PI control module 81) (Step S22B). Thereafter, an operation from Step S23 is performed.

Judgment in Step S25 is performed in the same manner as in Step S15 of FIG. 11 by the throttle controlling section 21.

A control operation for the shift mechanism 43 of the starboard-side outboard motor 12 is performed in substantially the same manner.

Figure 13:
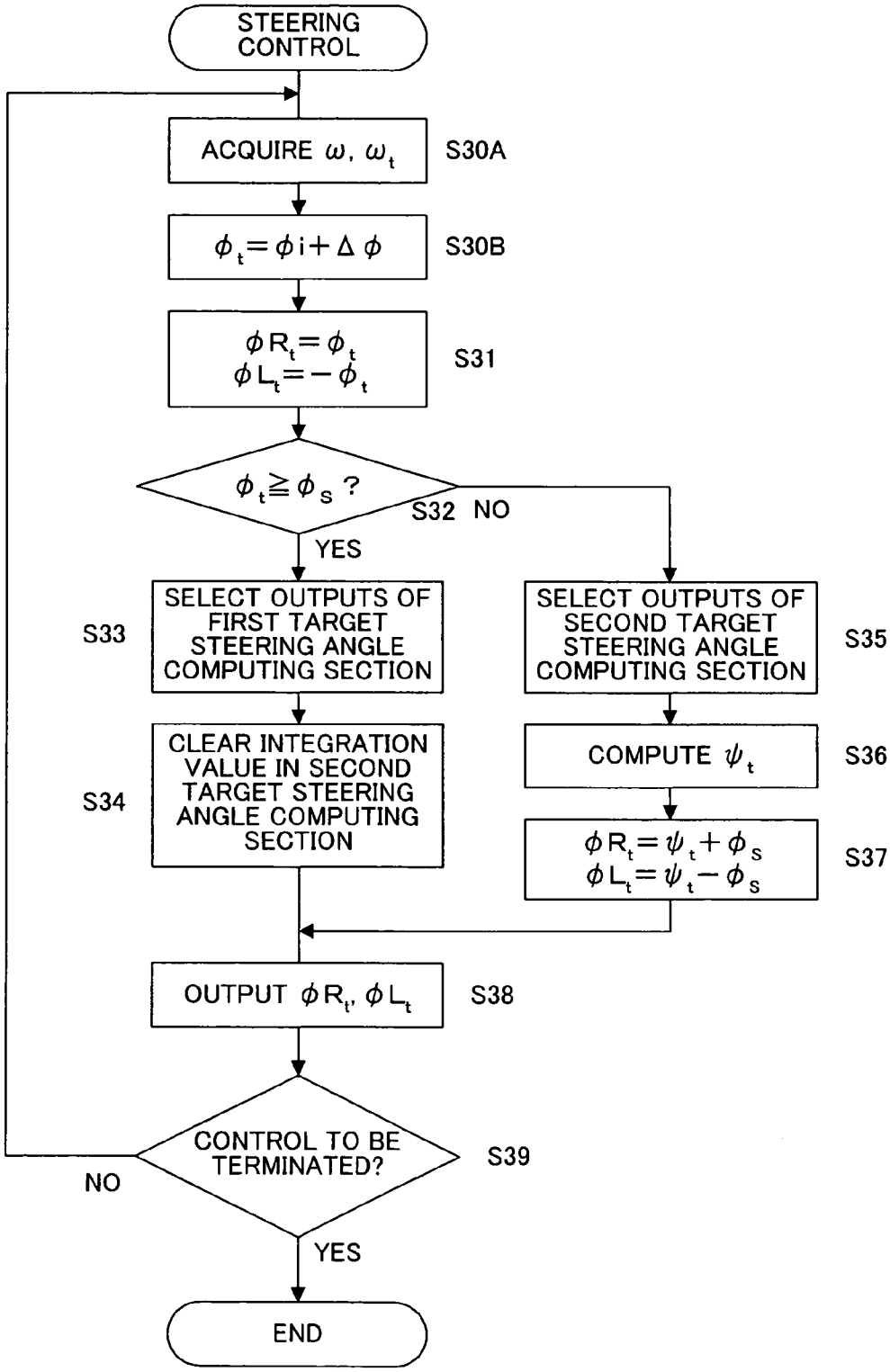
FIG. 13 is a flow chart for explaining the control operation to be performed by the steering controlling section in the lateral movement mode.

FIG. 13 is a flow chart for explaining a control operation to be performed by the steering controlling section 23 in the lateral movement mode. The steering controlling section 23 acquires the angular speed $\omega$ detected by the yaw rate sensor 9 and the target angular speed $\omega_t$ input from the lateral movement operational section 10 (Step S30A). The first target steering angle computing section 101 determines the target steering angle basic value $\phi_t=\phi i+\Delta\phi$ through the PI control (Step S30B). Then, the target steering angles $\phi L_t=-\phi_t$, $\phi R_t=\phi_t$ of the port-side and starboard-side outboard motors 11, 12 are determined and input to the selector 103 (Step S31).

On the other hand, the comparing section 104 compares the target steering angle basic value $\phi_t$ with the switching reference steering angle $\phi_S$ ($=\tan^{-1}(b/a_{max})$) (Step S32). If $\phi_t \geqq \phi_S$, the selector 103 is controlled to select the output of the first target steering angle computing section 101 (Step S33). Then, the steering controlling section 23 resets the integration value of the integrating section 118 of the second target steering angle computing section 102 to zero (Step S34). If $\phi_t<\phi_S$, the selector 103 is controlled to select the output of the second target steering angle computing section 102 (Step S35). The second target steering angle computing section 102 calculates the target steering angle correction value $\psi_t$ through the PI control (Step S36). Based on the target steering angle correction value $\psi_t$, the target steering angles $\phi L_t=\psi_t-\phi_S$, $\phi R_t=\psi_t+\phi_S$ of the port-side and starboard-side outboard motors 11, 12 are calculated (Step S37).

The target steering angles $\phi L_t$, $\phi R_t$ of the port-side and starboard-side outboard motors 11, 12 selected by the selector 103 are output to the outboard motor ECUs 13, 14 (Step S38). Therefore, the outboard motor ECUs 13, 14 respectively control the steering actuators 53 of the port-side and starboard-side outboard motors 11, 12 based on the applied target steering angles $\phi L_t$, $\phi R_t$. Thereafter, the steering controlling section 23 determines whether the control operation in the lateral movement mode is to be terminated (Step S39). The judgment is performed in the same manner as in Step S15 of FIG. 11 by the throttle controlling section 21. If the operation in the lateral movement mode is continued, the process beginning from Step S30A is repeated.

Figure 14:
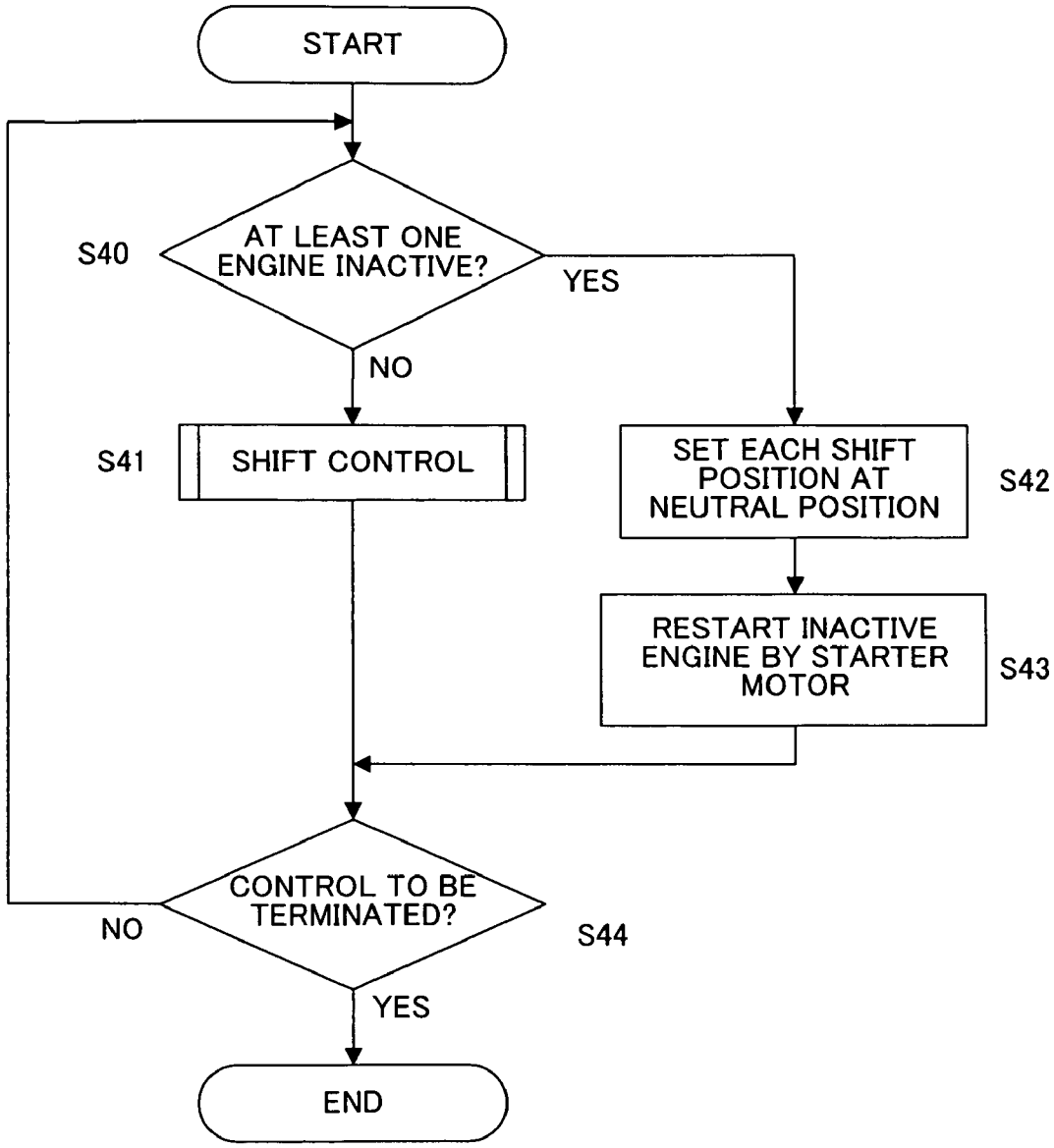
FIG. 14 is a flow chart for explaining an outboard motor stop detecting operation.

FIG. 14 is a flow chart for explaining an engine stop checking process to be performed in the lateral movement mode by the engine state judging section 90 of the shift controlling section 22 for checking the engine stop of the outboard motors 11, 12. The engine state judging section 90 monitors the engine speeds NL, NR applied from the outboard motor ECUs 13, 14 to determine whether or not the engines 39 of the outboard motors 11, 12 are inactive (Step S40). If the engines 39 of the outboard motors 11, 12 are both active, the shift position outputting sections 95 continuously control the respective shift mechanisms 43 (Step S41).

On the other hand, if the inactive state of at least one of the engines 39 of the outboard motors 11, 12 is detected, a command for setting the shift position of each of the shift mechanisms 43 of the outboard motors 11, 12 at the neutral position is applied to the shift position outputting sections 95 (Step S42). Thus, neither of the outboard motors 11, 12 generate the propulsive forces. Then, a restart command for restarting the inactive engine 39 is applied to the corresponding one of the outboard motor ECUs 13, 14 of the outboard motors 11, 12 from the engine state judging section 90 (Step S43). Thus, the inactive engine 39 is restarted by the starter motor 45 of the corresponding outboard motor 11, 12.

Thereafter, the engine state judging section 90 determines whether the control operation is to be terminated (Step S44). The judgment is performed in the same manner as in Step S15 of FIG. 11 by the throttle controlling section 21. If the control operation in the lateral movement mode is continued, the process beginning from Step S40 is repeated.

Figure 15:
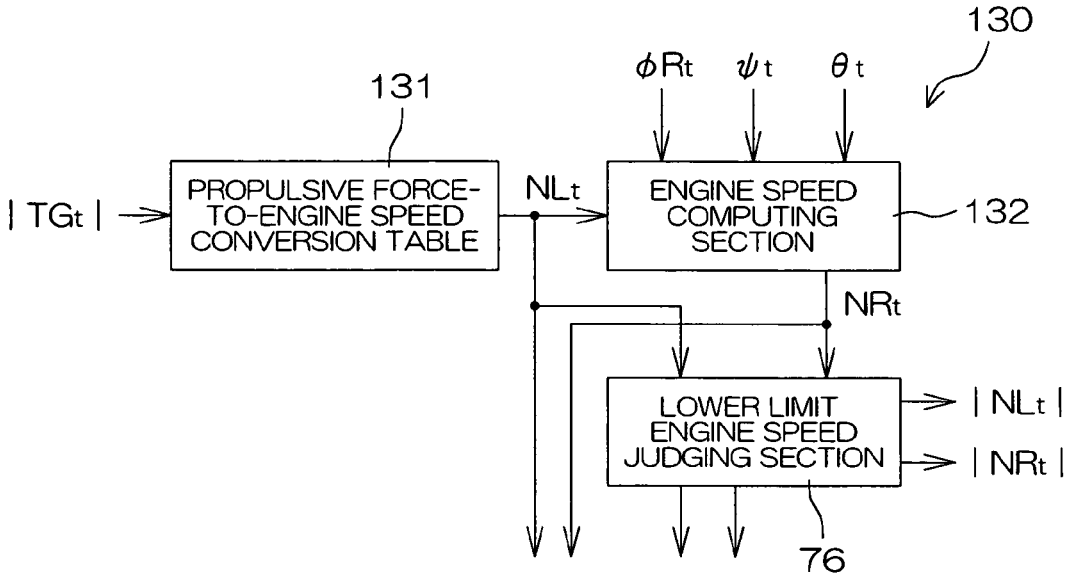
FIG. 15 is a block diagram illustrating a second preferred embodiment of the present invention, particularly illustrating an engine speed calculating module to be employed in place of an engine speed calculating module shown in FIG. 8.

FIG. 15 is a block diagram illustrating a second preferred embodiment of the present invention, and particularly illustrating the construction of an engine speed calculating module 130 to be provided instead of the target engine speed calculating module 70 shown in FIG. 8. In FIG. 15, functional components corresponding to those shown in FIG. 8 are denoted by the same reference characters as in FIG. 8. Further, reference will be made again to FIGS. 1 to 14.

In this preferred embodiment, the target engine speed $NL_t$ of the port-side outboard motor 11 is determined according to the target combined propulsive force $|TG_t|$ applied from the lateral movement operational section 10 by a propulsive force-to-engine speed conversion table 131 (first rotational speed setting section). The target engine speed $NL_t$ is applied to an engine speed computing section 132 (second rotational speed setting section). Further, the target steering angle $\phi R_t$ (or the detected steering angle $\phi R$) of the starboard-side outboard motor 12, the target steering angle correction value $\psi_t$ and the target movement angle $\theta_t$ are applied to an engine speed computing section 132. Based on the target engine speed $NL_t$, the target steering angle $\phi R_t$, the target steering angle correction value $\psi_t$ and the target movement angle $\theta_t$, the engine speed computing section 132 determines the target engine speed $NR_t$ for the engine 39 of the starboard-side outboard motor 12 so as to provide the combined propulsive force for moving the hull 2 at the target movement angle $\theta_t$.

The target engine speed $NL_t$ is not necessarily equal to an engine speed required to generate a propulsive force from the outboard motor 11 for providing the target combined propulsive force $|TG_t|$, but is preferably less than that engine speed. In the lateral maneuvering operation, the directions of the propulsive forces generated by the outboard motors 11, 12 are significantly different from the movement direction of the hull 2 and, therefore, the engines 39 of the outboard motors 11, 12 are operated at high engine speeds in spite of the fact that the combined propulsive force $|TG|$ is relatively small. Therefore, a loud engine sound arouses unnatural or uncomfortable feeling in the operator and the crew during the lateral maneuvering operation.

In this preferred embodiment, the operation amount of the lateral movement operational section 10 is associated with the engine speed of the port-side outboard motor 11. Therefore, the engines 39 are operated at engine speeds that are expected in association with the operation amount of the lateral movement operational section 10 by the operator. As a result, the uncomfortable feeling attributable to the loud engine sound is mitigated. Since the engine speeds can be provided according to the operation amount of the lateral movement operational section 10, the operator's unnatural feeling is eliminated.

While two preferred embodiments of the present invention have thus been described, the present invention may be embodied in many other ways. In the preferred embodiments described above, it is assumed that the instantaneous center G of the hull 2 varies. However, where the instantaneous center G is considered to be virtually fixed, the construction of the marine vessel running controlling apparatus and the control method is simplified. More specifically, target steering angle basic values $\phi_t$ may be preliminarily defined for different target angular speeds $\omega_t$ and stored in a memory. In this case, the target steering angles $\phi L_t$, $\phi R_t$ of the port-side and starboard-side outboard motors 11, 12 are determined by reading a target steering angle basic value $\phi_t$ from the memory in the lateral movement mode. If it is possible to fix the target angular speed $\omega_t$ at zero, the target steering angle basic value $\phi_t$ in the lateral movement mode may be fixed at a value which is determined by a geometrical relationship between the instantaneous center G and the propulsive force generating positions of the outboard motors 11, 12 (to coincide the action point F with the instantaneous center G). In this case, the construction of the marine vessel running controlling apparatus and the control method is further simplified.

The propulsive forces are controlled by controlling the outputs of the engines 39 in the preferred embodiments described above. However, the propulsive forces may be controlled by using propulsion systems including a variable pitch propeller whose propeller angle (pitch) is controllable. In this case, target pitches of the variable pitch propellers are calculated according to target propulsive forces, and the pitches of the variable pitch propellers are set at the target pitches thus calculated.

Although the preferred embodiments described above are directed to the marine vessel 1 including two outboard motors 11, 12, the marine vessel 1 may further include a third outboard motor provided on the center line 5 of the hull 2.

While the present invention has been described in detail with reference to the preferred embodiments thereof, it should be understood that the foregoing disclosure is merely illustrative of the technical principles of the present invention but not limitative of the same. The spirit and scope of the present invention are to be limited only by the appended claims.

This application corresponds to Japanese Patent Application No. 2003-361461 filed with the Japanese Patent Office on Oct. 22, 2003, the disclosure of which is incorporated herein by reference.

What is claimed is:

1. A propulsive force controlling apparatus for controlling a propulsion system that is attached to a hull of a marine vessel and includes a motor and a propulsive force generating member which receives a torque from the motor to generate a propulsive force, the propulsive force controlling apparatus comprising:

a clutch mechanism which operates only in either a coupling state which permits transmission of the torque from the motor to the propulsive force generating member with virtually no slippage and a decoupling state which prohibits the transmission of the torque from the motor to the propulsive force generating member;

a clutch actuator which actuates the clutch mechanism;

a target propulsive force acquiring section which acquires a target propulsive force to be generated by the propulsion system, the target propulsive force acquiring section includes a target rotational speed acquiring section which acquires a target rotational speed of the motor; and a clutch controlling section including a rotational speed comparing section which compares the target rotational speed acquired by the target rotational speed acquiring section with a predetermined lower limit to judge whether to perform an intermittent coupling control operation to intermittently maintain the clutch mechanism in the coupling state, and which performs the intermittent coupling control operation if the target rotational speed is lower than the lower limit.

2. A propulsive force controlling apparatus as set forth in claim 1, wherein the clutch controlling section includes:

a coupling duration calculating section which calculates a duration of the coupling state in a predetermined control period according to the target propulsive force acquired by the target propulsive force acquiring section; and an intermittent coupling controlling section which maintains the clutch mechanism in the coupling state for the duration calculated by the coupling duration calculating section, and maintains the clutch mechanism in the decoupling state for the rest of the control period for switching the clutch mechanism alternately between the coupling state and the decoupling state.

3. A propulsive force controlling apparatus as set forth in claim 2, further comprising a motor controlling section which drives the motor at a predetermined reference rotational speed if the comparison result provided by the target rotational speed comparing section indicates that the target rotational speed is lower than the lower limit, wherein the coupling duration calculating section calculates the duration of the coupling state of the clutch mechanism so as to provide a propulsive force that is equivalent to a propulsive force to be generated by driving the motor at the target rotational speed, if the comparison result provided by the target rotational speed comparing section indicates that the target rotational speed is lower than the lower limit.

4. A propulsive force controlling apparatus as set forth in claim 3, wherein the coupling duration calculating section calculates the duration of the coupling state of the clutch mechanism from the following expression:

$$s=(Na/Nb)\cdot S$$

wherein s is the duration of the coupling state, Na is the target rotational speed, Nb is the reference rotational speed, and S is the control period.

5. A propulsive force controlling apparatus as set forth in claim 3, wherein the reference rotational speed is equal to the lower limit.

6. A propulsive force controlling apparatus as set forth in claim 1, wherein the marine vessel includes a plurality of propulsion systems attached to the hull, and the clutch controlling section controls clutch actuators provided in the respective propulsion systems so that clutch mechanisms provided in the respective propulsion systems are switched between the coupling state and the decoupling state in synchronization with each other during the intermittent coupling control operation for intermittently maintaining the clutch mechanisms in the coupling state.

7. A propulsive force controlling apparatus as set forth in claim 1, further comprising a motor state judging section which judges whether the motor is active or inactive, wherein the clutch controlling section interrupts the intermittent coupling control operation of the clutch mechanism if the motor state judging section determines that the motor, is inactive during the intermittent coupling control operation, and restarts the intermittent coupling control operation when the motor state judging section thereafter determines that the motor is active.

8. A propulsive force controlling apparatus as set forth in claim 7, wherein the marine vessel includes a plurality of propulsion systems attached to the hull, the motor state judging section judges whether motors provided in the respective propulsion systems are each active or inactive, and the clutch controlling section interrupts the intermittent coupling control operation of all clutch mechanisms provided in the respective propulsion systems if the motor state judging section determines that at least one of the motors is inactive during the intermittent coupling control operation of the clutch mechanisms.

9. A propulsive force controlling apparatus as set forth in claim 7, further comprising a restart controlling section which restarts the motor that has been judged to be inactive by the motor state judging section.

10. A propulsive force controlling apparatus as set forth in claim 1, wherein the clutch mechanism can be switched among a forward drive coupling state in which the torque is transmitted from the motor to the propulsive force generating member so as to move the hull forward, a rearward drive coupling state in which the torque is transmitted from the motor to the propulsive force generating member so as to move the hull rearward, and the decoupling state which prohibits the transmission of the torque from the motor to the propulsive force generating member.

11. A marine vessel maneuvering supporting system for supporting maneuvering of a marine vessel having a hull and a propulsion system attached to the hull, the propulsion system including a motor and a propulsive force generating member which receives a torque from the motor to generate a propulsive force, the marine vessel maneuvering supporting system comprising:

a clutch mechanism which operates only in either a coupling state which permits transmission of the torque from the motor to the propulsive force generating member with virtually no slippage and a decoupling state which prohibits the transmission of the torque from the motor to the propulsive force generating member;

a clutch actuator which actuates the clutch mechanism;

a target propulsive force inputting section for inputting a target propulsive force to be generated by the propulsion system; and a propulsive force controlling apparatus which controls the propulsion system on the basis of the target propulsive force input from the target propulsive force inputting section, the propulsive force controlling apparatus including:

a target propulsive force acquiring section which acquires the target propulsive force input from the target propulsive force inputting section, the target propulsive force acquiring section includes a target rotational speed acquiring section which acquires a target rotational speed of the motor; and a clutch controlling section including a rotational speed comparing section which compares the target rotational speed acquired by the target rotational speed acquiring section with a predetermined lower limit to judge whether to perform an intermittent coupling control operation to intermittently maintain the clutch mechanism in the coupling state and which performs the intermittent coupling control operation if the target rotational speed is lower than the lower limit.

12. A marine vessel comprising:

a hull;

a propulsion system attached to the hull and including a motor, a propulsive force generating member which receives a torque from the motor to generate a propulsive force, a clutch mechanism which operates only in either a coupling state which permits transmission of the torque from the motor to the propulsive force generating member with virtually no slippage and a decoupling state which prohibits the transmission of the torque from the motor to the propulsive force generating member, and a clutch actuator which actuates the clutch mechanism;

a target propulsive force inputting section for inputting a target propulsive force to be generated by the propulsion system; and a propulsive force controlling apparatus which controls the propulsion system on the basis of the target propulsive force input from the target propulsive force inputting section, the propulsive force controlling apparatus including:

a target propulsive force acquiring section which acquires the target propulsive force input from the target propulsive force inputting section, the target propulsive forceacquiring section includes a target rotational speed acquiring section which acquires a target rotational speed of the motor; and a clutch controlling section including a rotational speed comparing section which compares the target rotational speed acquired by the target rotational speed acquiring section with a predetermined lower limit to judge whether to perform an intermittent coupling control operation to intermittently maintain the clutch mechanism in the coupling state, and which performs the intermittent coupling control operation if the target rotational speed is lower than the lower limit.

13. A propulsive force controlling method for controlling a propulsion system attached to a hull of a marine vessel and including a motor, a propulsive force generating member which receives a torque from the motor to generate a propulsive force, a clutch mechanism which operates only in either a coupling state which permits transmission of the torque from the motor to the propulsive force generating member with virtually no slippage and a decoupling state which prohibits the transmission of the torque from the motor to the propulsive force generating member, and a clutch actuator which actuates the clutch mechanism, the method comprising the steps of:

acquiring a target propulsive force to be generated by the propulsion system;

the target propulsive force acquiring step includes the step of acquiring a target rotational speed of the motor;

comparing the acquired target rotational speed with a predetermined lower limit to judge whether to perform an intermittent coupling control operation to intermittently maintain the clutch mechanism in the coupling state; and performing the intermittent coupling control operation if the target rotational speed is lower than the lower limit.

* * * * *